US010252877B2

(12) United States Patent
Sunaoshi et al.

(10) Patent No.: US 10,252,877 B2
(45) Date of Patent: Apr. 9, 2019

(54) SHEET SEPARATOR, SHEET POST-PROCESSING DEVICE, AND IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventors: Takamitsu Sunaoshi, Yokohama Kanagawa (JP); Misato Ishikawa, Kawasaki Kanagawa (JP); Takahiro Kokubo, Kamakura Kanagawa (JP); Shunsuke Hattori, Kawasaki Kanagawa (JP); Kikuo Mizutani, Izu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 93 days.

(21) Appl. No.: 15/439,765

(22) Filed: Feb. 22, 2017

(65) Prior Publication Data

US 2018/0148294 A1 May 31, 2018

(30) Foreign Application Priority Data

Nov. 25, 2016 (JP) ..... 2016-229575

(51) Int. Cl.
*B65H 31/32* (2006.01)
*B65H 37/04* (2006.01)
(Continued)

(52) U.S. Cl.
CPC ..... *B65H 31/32* (2013.01); *B65H 31/02* (2013.01); *B65H 35/0066* (2013.01);
(Continued)

(58) Field of Classification Search
CPC . Y10S 156/908; B42C 9/0068; B42C 9/0075; B42C 9/0056
See application file for complete search history.

(56) References Cited

U.S. PATENT DOCUMENTS 2,455,971 A * 12/1948 Bosch ..... B42C 5/06 118/238
3,992,741 A * 11/1976 Staats ..... B42C 9/0056 412/20

(Continued)

FOREIGN PATENT DOCUMENTS

| | | | |
|---|---|---|---|
| JP | H05309975 | A | 11/1993 |
| JP | 2007153463 | A | 6/2007 |
| JP | 2009007166 | A | 1/2009 |
| JP | 2014177056 | A | 9/2014 |
| JP | 2016030400 | A | 3/2016 |
| JP | 2016148018 | A | 8/2016 |

*Primary Examiner* — Jennifer E Simmons
(74) *Attorney, Agent, or Firm* — Kim & Stewart LLP

(57) ABSTRACT

According to one embodiment, a sheet separator has a first driving roller and a pressing body. The first driving roller rotates about a first rotation shaft. The first driving roller conveys a sheet bundle including a plurality of sheets. The pressing body is capable of approaching the first driving roller. The first driving roller is rotatable in a first direction with the sheet bundle sandwiched between the first driving roller and the pressing body. The pressing body pivots in the first direction about the first rotation shaft with the sheet bundle sandwiched between the first driving roller and the pressing body to cause the plurality of sheets to deviate from one another at edges.

9 Claims, 16 Drawing Sheets

(51) Int. Cl.

| | |
|---|---|
| ***G03G 15/00*** | (2006.01) |
| ***B65H 31/02*** | (2006.01) |
| ***B65H 35/00*** | (2006.01) |

(52) U.S. Cl.

CPC ..... *B65H 37/04* (2013.01); *G03G 15/6541* (2013.01); *G03G 15/6544* (2013.01); *G03G 15/6547* (2013.01); *B65H 2301/4212* (2013.01); *B65H 2301/4213* (2013.01); *B65H 2301/4227* (2013.01); *B65H 2301/42194* (2013.01); *B65H 2301/43821* (2013.01); *B65H 2301/516* (2013.01); *B65H 2301/51122* (2013.01); *B65H 2405/1134* (2013.01); *B65H 2405/11151* (2013.01); *B65H 2801/27* (2013.01)

(56) References Cited

U.S. PATENT DOCUMENTS

| | | | | |
|---|---|---|---|---|
| 4,518,296 | A * | 5/1985 | Pearson | B42C 9/0056 281/21.1 |
| 6,024,525 | A * | 2/2000 | Yamanaka | B42C 9/0075 412/11 |
| 8,267,399 | B2 | 9/2012 | Kushida et al. | |
| 2004/0028505 | A1 * | 2/2004 | Bilbrey | B42C 9/0068 412/8 |
| 2008/0298929 | A1 | 12/2008 | Hirai et al. | |
| 2016/0031200 | A1 | 2/2016 | Taki et al. | |

* cited by examiner

SHEET SEPARATOR, SHEET POST-PROCESSING DEVICE, AND IMAGE FORMING APPARATUS

CROSS-REFERENCE TO RELATED APPLICATION

This application claims priority from Japanese Patent Application No. 2016-229575 filed on Nov. 25, 2016, the contents of which are incorporated herein by reference in their entirety.

FIELD

Embodiments described herein relate generally to a sheet separator, a sheet post-processing device, and an image forming apparatus.

BACKGROUND

It is required to realize a sheet separator that causes a plurality of sheets constituting a sheet bundle to be displaced from one another at edges, by use of a simple mechanism.

DETAILED DESCRIPTION

Figure 1:
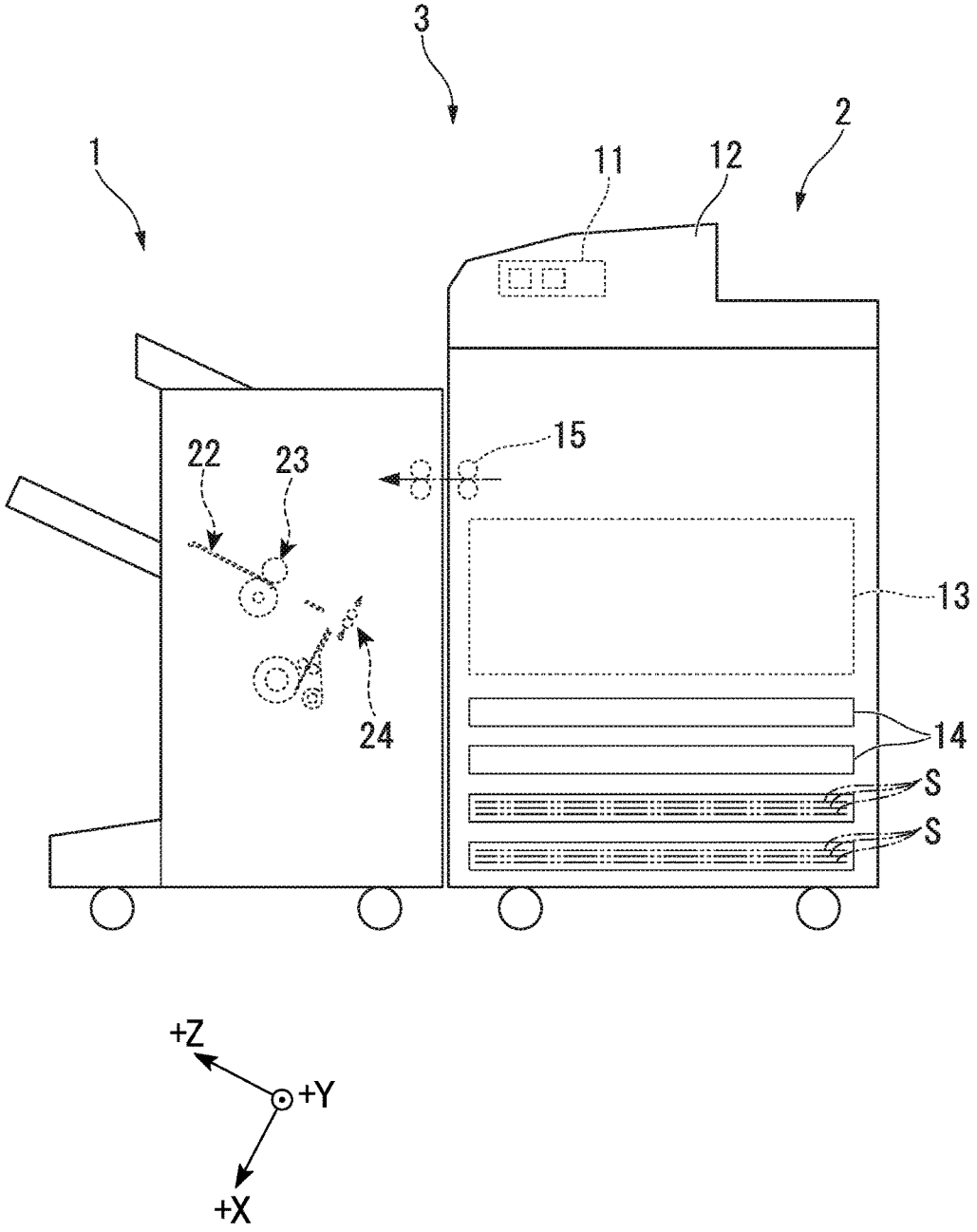
FIG. 1 is a front view showing an image forming apparatus including a sheet post-processing device having a sheet separator of an embodiment.

According to one embodiment, a sheet separator has a first driving roller and a pressing body. The first driving roller rotates about a first rotation shaft. The first driving roller conveys a sheet bundle including a plurality of sheets. The pressing body is capable of approaching the first driving roller. The first driving roller is rotatable in a first direction with the sheet bundle sandwiched between the first driving roller and the pressing body. The pressing body pivots in the first direction about the first rotation shaft with the sheet bundle sandwiched between the first driving roller and the pressing body to cause the plurality of sheets to deviate from one another at edges.

Hereinafter, a sheet separator, a sheet post-processing device, and an image forming apparatus according to an embodiment will be described with reference to the drawings. In the following description, configurations having the same or similar functions are denoted with the same reference numerals. Repeated description of the configurations may be omitted. In this disclosure, various sheet-shaped media including paper or the like are referred to as "sheets".

An embodiment will be described with reference to FIGS. 1 to 18.

FIG. 1 is a front view showing an image forming apparatus 3 including a sheet post-processing device 1 including a sheet separator 23 according to this embodiment. For example, the sheet post-processing device 1 performs post-processing on a sheet S that is conveyed from an image former 2. The sheet post-processing device 1 (also referred to as a sheet processing device) may be placed on, for example, a desktop or a floor surface and used alone.

As shown in FIG. 1, the image forming apparatus 3 includes the sheet post-processing device 1, and the image former 2.

The image former 2 includes a control panel 11, a scanner 12, a printer 13, a sheet feeder 14, and a sheet discharger 15.

The control panel 11 includes various keys or the like, and receives an operation of a user. Information input through an operation with respect to the control panel 11 can be sent as a portion of a command to the sheet post-processing device 1.

The scanner 12 reads image information of a copy target. The printer 13 forms an image on the sheet S on the basis of image information received from the scanner 12 or an external device. The sheet feeder 14 supplies the sheet S to the printer 13. The sheet discharger 15 conveys the sheet S discharged from the printer 13 to the sheet post-processing device 1.

Next, the sheet post-processing device 1 will be described.

Figure 2:
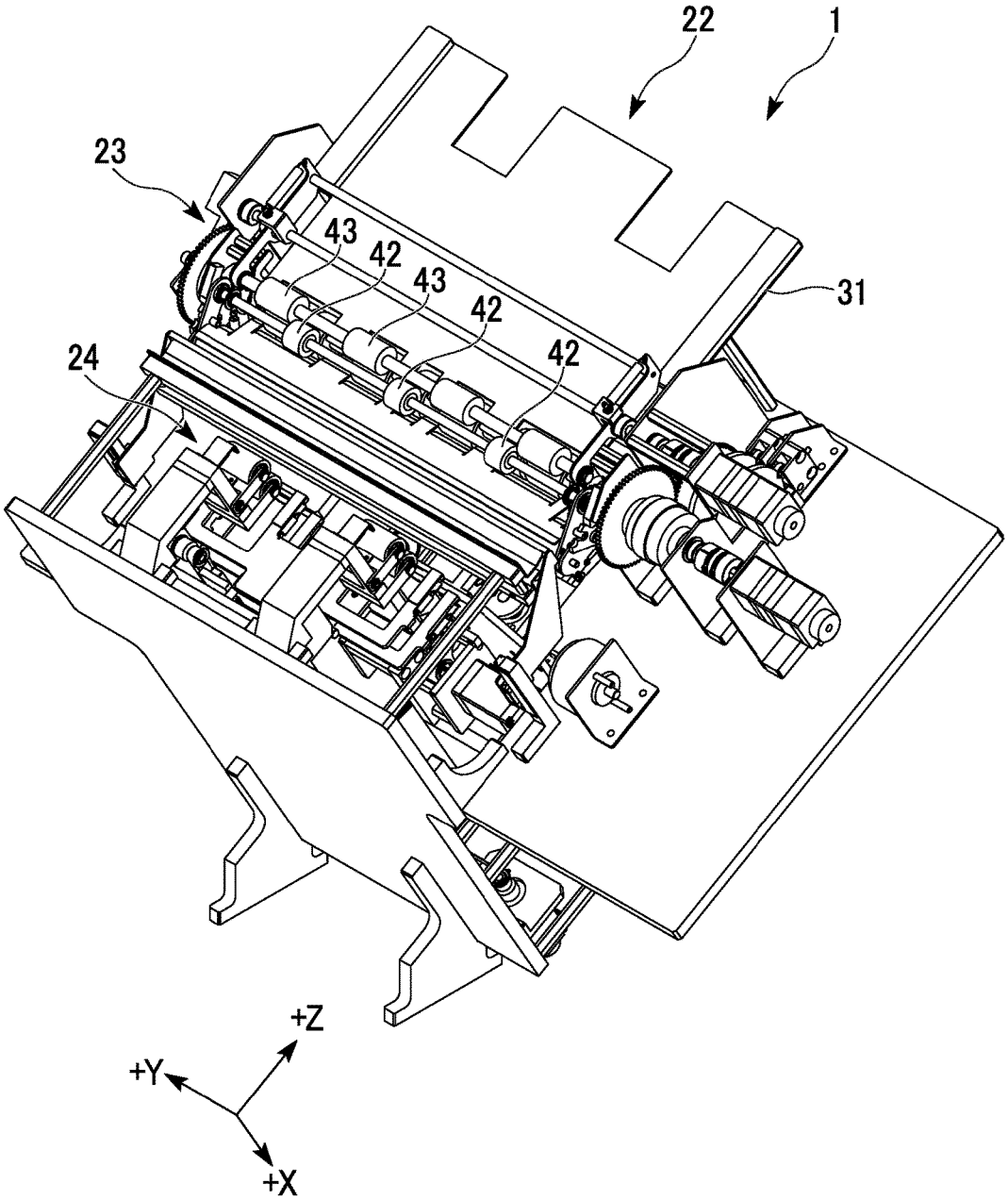
FIG. 2 is a perspective view showing the sheet post-processing device having the sheet separator of the embodiment.
Figure 3:
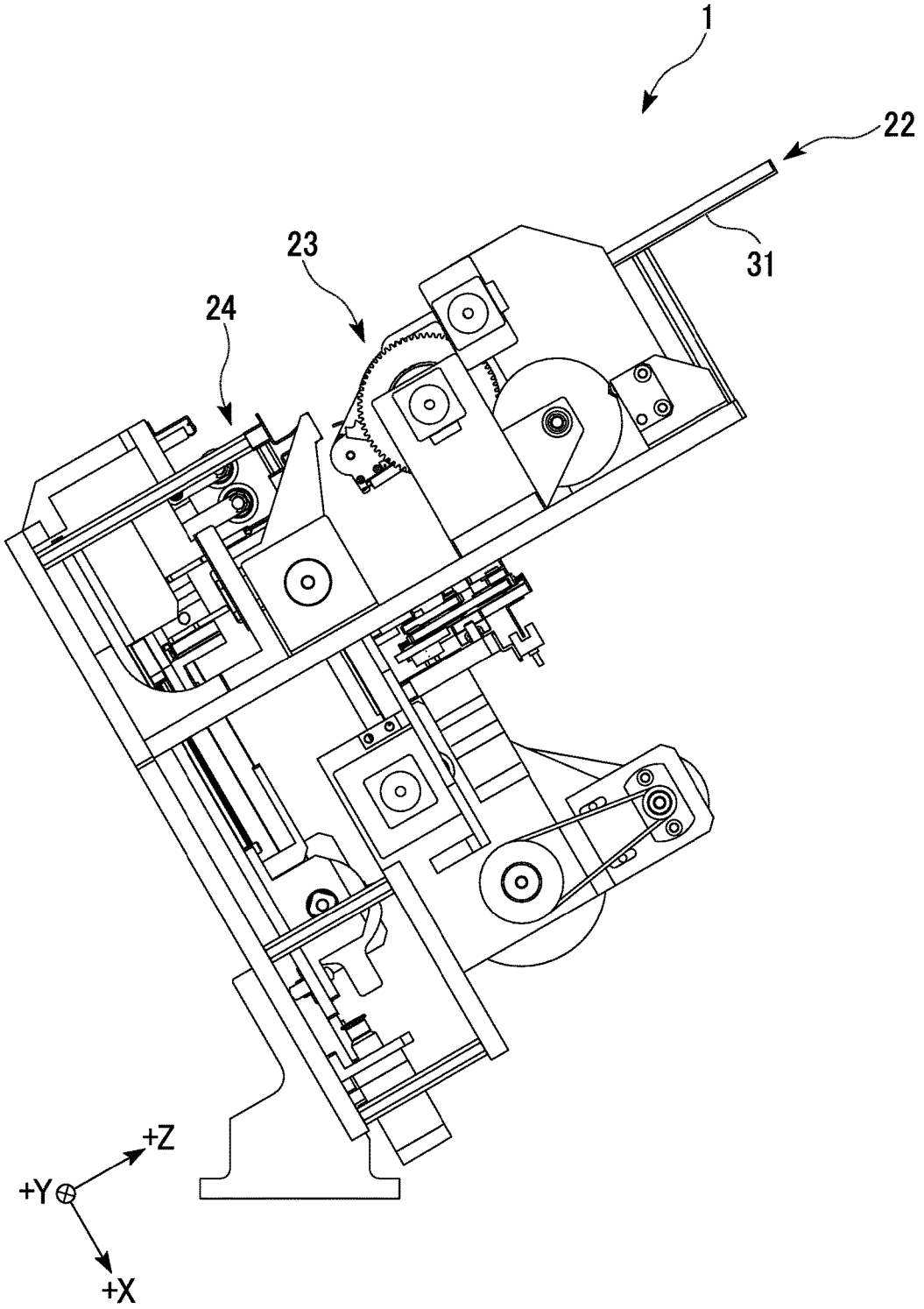
FIG. 3 is a front view showing an internal configuration of the sheet post-processing device having a sheet separator of the embodiment.

FIG. 2 is a perspective view showing the sheet post-processing device 1. FIG. 3 is a front view showing an internal configuration of the sheet post-processing device 1.

As shown in FIGS. 2 and 3, the sheet post-processing device 1 includes a bundle creator 22, a sheet separator 23, a sheet binding device 24, and an interface (information acquisition unit) (not shown in the figure).

The interface acquires information of a plurality of sheets, a tape, a method of binding a sheet bundle by use of the tape, or the like by receiving the information as a portion of a command from the image former (external device).

Figure 4:
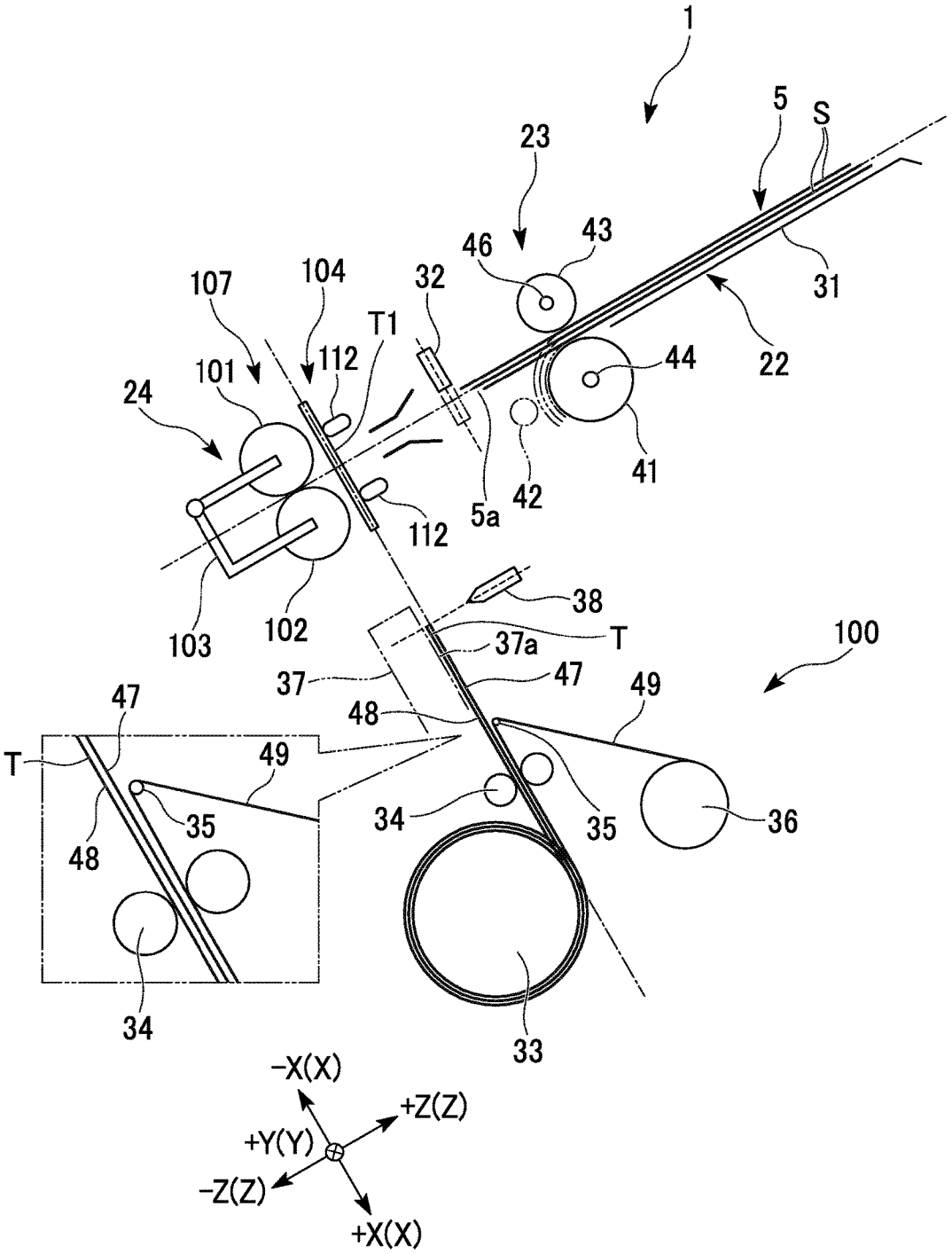
FIG. 4 is a schematic configuration diagram showing an internal configuration of the sheet post-processing device having a sheet separator of the embodiment.

FIG. 4 is a schematic configuration diagram showing an internal configuration of the sheet post-processing device 1.

As shown in FIG. 4, the bundle creator 22 creates a sheet bundle 5 including a plurality of sheets S by stacking a plurality of sheets S. The bundle creator 22 includes a main guide 31 and a stopper 32.

The main guide 31 guides the sheet S in a sheet conveyance direction. The sheets S are sequentially stacked on the main guide 31, thereby forming the sheet bundle 5.

The stopper 32 is provided at a downstream side end of the main guide 31 in the sheet conveyance direction. The stopper 32 is movable between a restriction position (indicated by a two-dot chain line in FIG. 4) and a release position (indicated by a solid line in FIG. 4) by a moving mechanism, which is not shown in the figure.

When the stopper 32 is at the restriction position, an end of the sheet S comes into contact with the stopper 32, and thereby a movement of the sheet S in the sheet conveyance direction is restricted. As the movement of the sheet S is restricted, the sheet bundle 5 including a plurality of sheets S is formed on the main guide 31.

When the stopper 32 is at the release position, the sheet bundle 5 does not come into contact with the stopper 32, but is movable in the sheet conveyance direction.

The sheet separator 23 causes the plurality of sheets S to be sequentially displaced in the sheet conveyance direction little by little, thereby forming a state in which the plurality of sheets S forming the sheet bundle 5 are displaced from one another at the edge 5*a* of the sheet bundle 5. For example, the sheet separator 23 forms a state in which the plurality of sheets S are displaced in a stepwise manner at the edge 5*a* of the sheet bundle 5.

FIG. 5 is a side view showing a state in which the plurality of sheets S are displaced at an edge 5*a* of the sheet bundle 5.

Figure 5A:
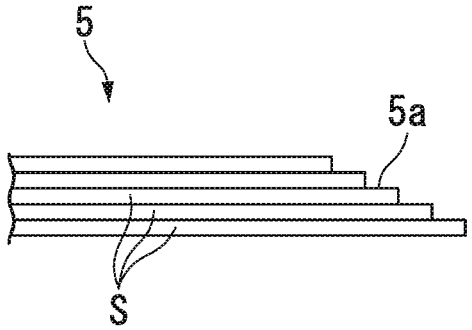
FIGS. 5A and 5B are a side view showing a state in which a plurality of sheets are displaced at an edge of a sheet bundle in the embodiment.
Figure 5B:
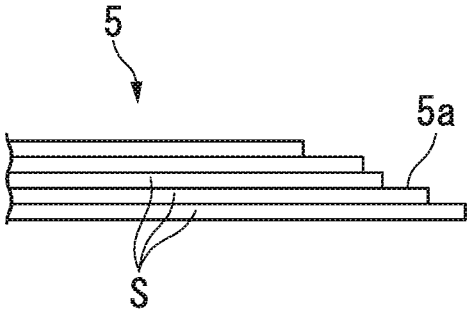

As shown in FIG. 5, "a state in which the plurality of sheets S forming the sheet bundle 5 are displaced from one another at the edge 5*a*" described in this disclosure means a state in which the plurality of sheets S are displaced from one another and overlap. In other words, the state means a state in which the edges of the plurality of stacked sheets S are displaced from one another, and the edges of the sheets S forming the sheet bundle 5 form steps. In other words, the state means that some of the plurality of sheets S overlap in a layer shape. Further, "a state in which the plurality of sheets S forming the sheet bundle 5 are displaced in a stepwise manner at the edge 5*a*" described in this disclosure means, for example, a state in which the amount of projection in a sheet conveyance direction of each sheet S gradually increases (or gradually decreases) in a stacking order of the plurality of sheets S. The present invention is not limited to the state in which a plurality of sheets S substantially uniformly are displaced from one another (see FIG. 5A), and the plurality of sheets S may be non-uniformly displaced from one another (see FIG. 5B).

Figure 6:
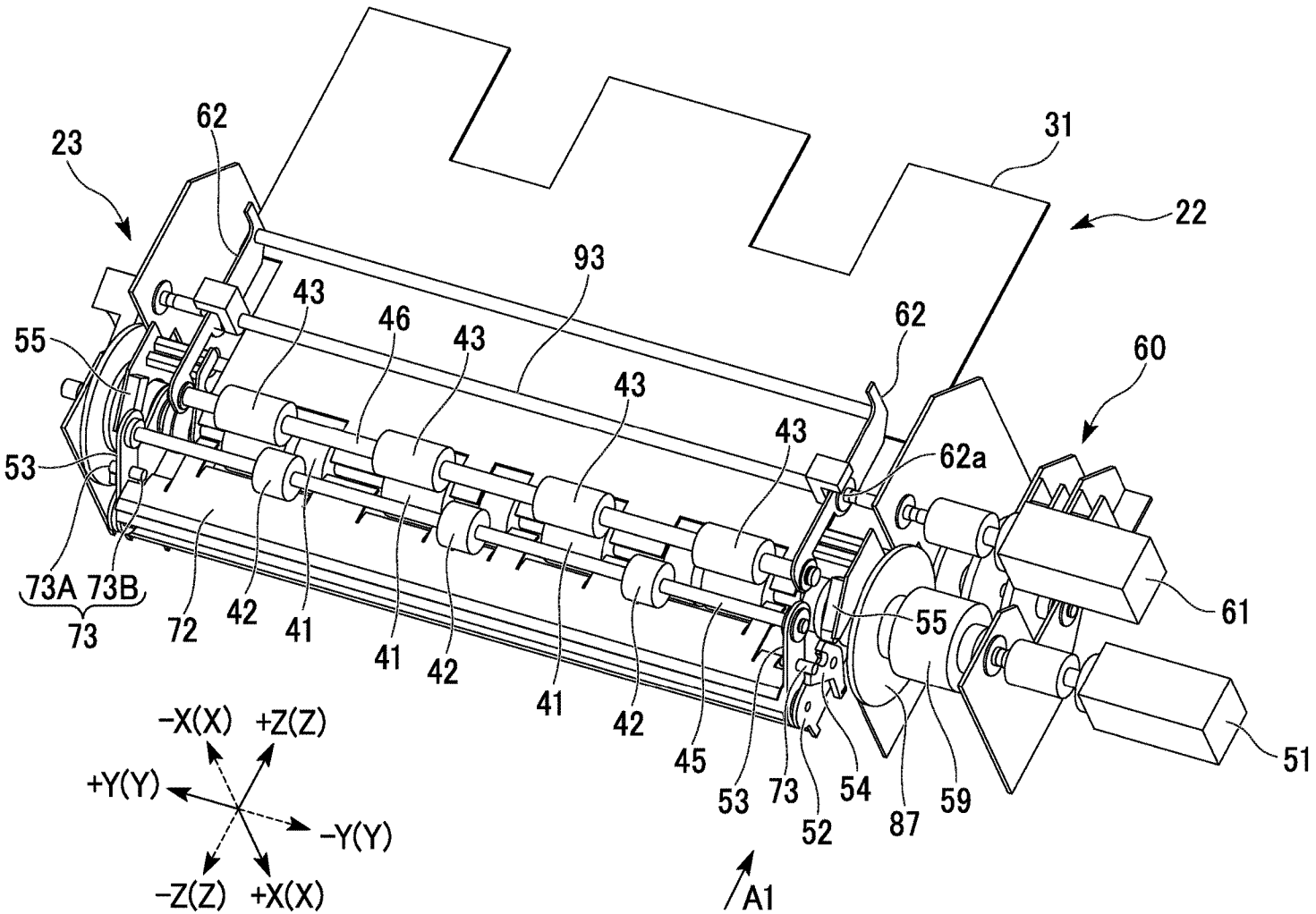
FIG. 6 is a perspective view showing an internal configuration of the sheet separator of the embodiment.
Figure 7:
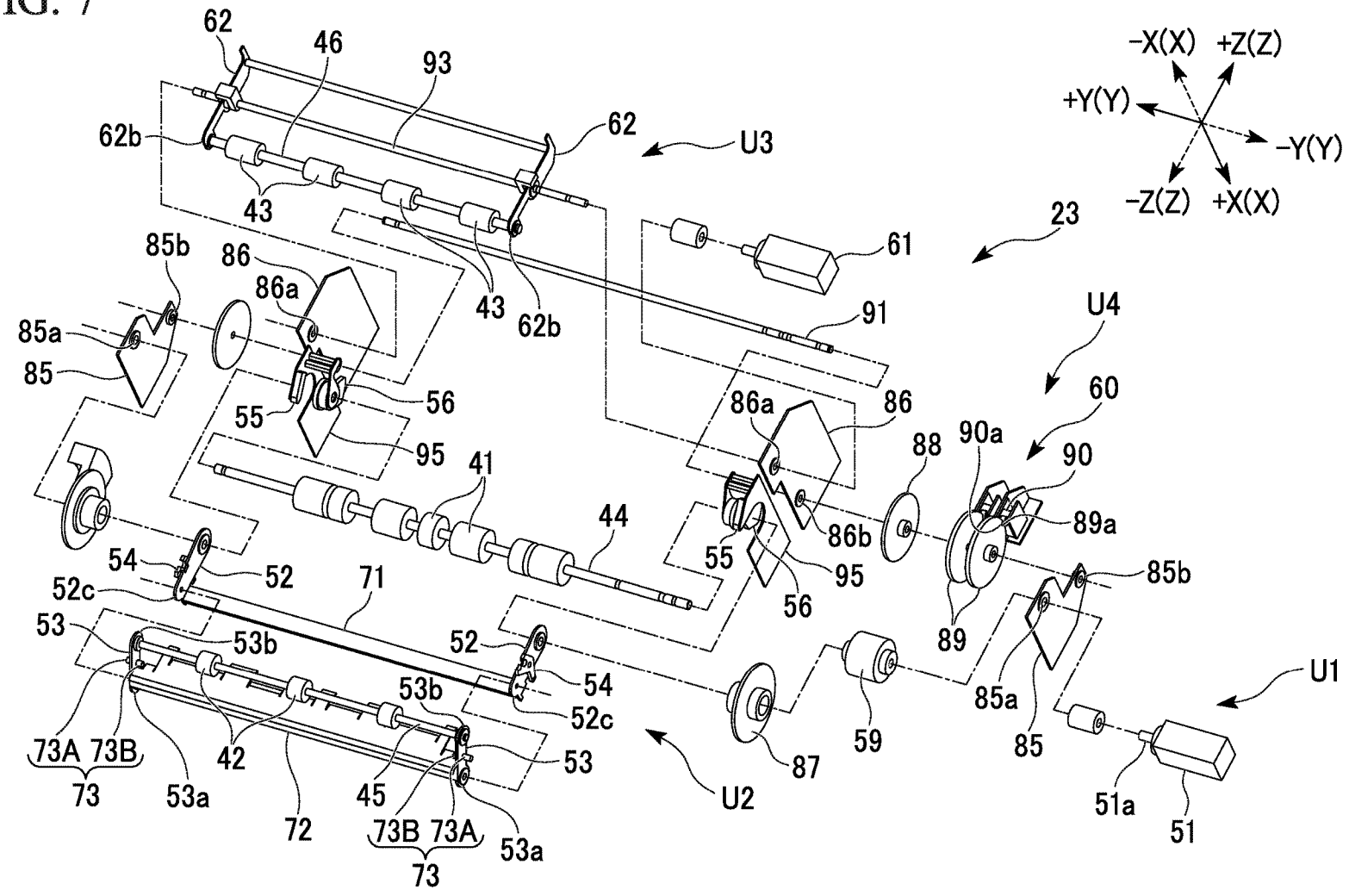
FIG. 7 is an exploded perspective view showing the sheet separator of the embodiment.
Figure 8:
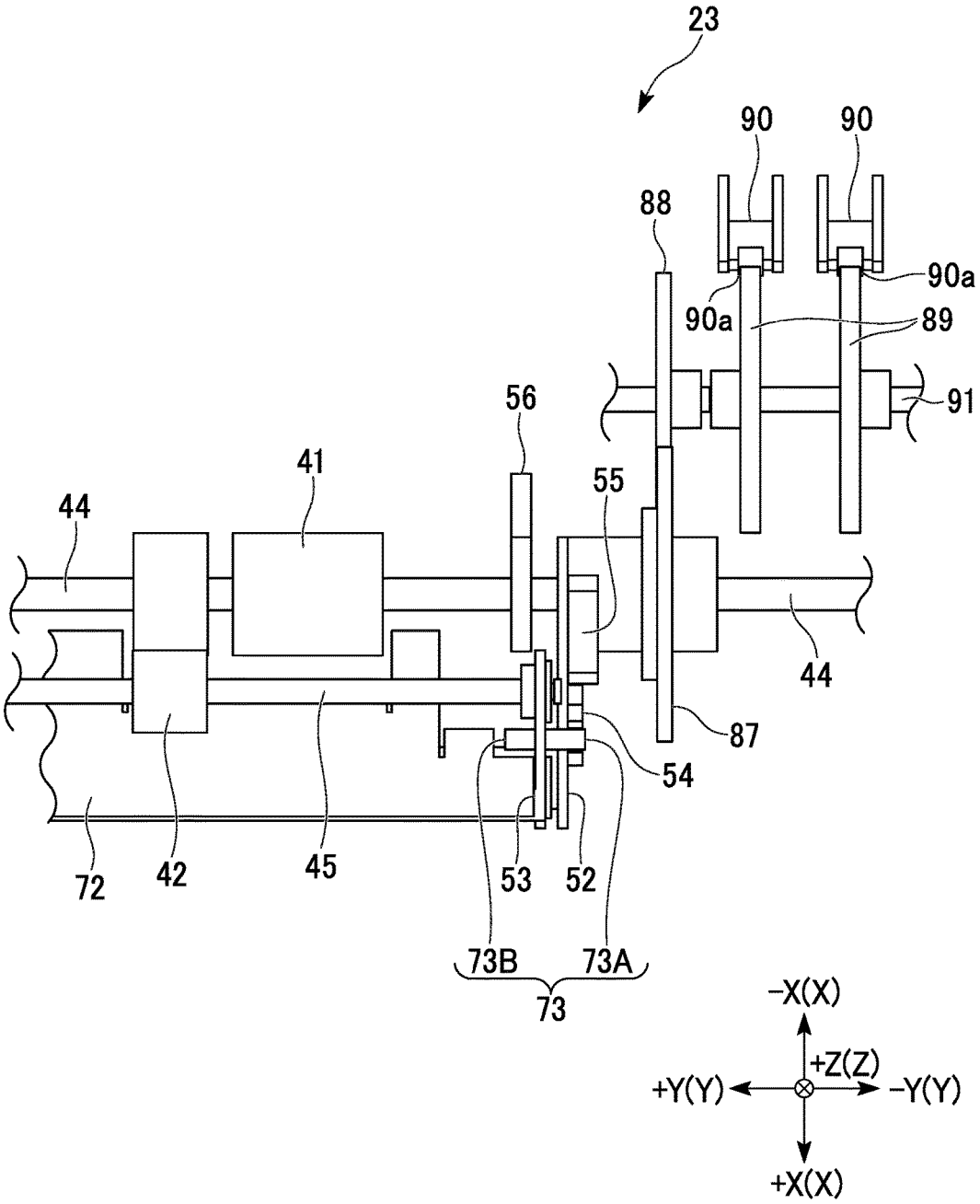
FIG. 8 is a configuration view showing a portion of the sheet separator of the embodiment when viewed from a direction A1 in FIG. 6.

FIG. 6 is a perspective view showing an internal configuration of the sheet separator 23. FIG. 7 is an exploded perspective view showing the sheet separator 23. FIG. 8 is a configuration diagram of a portion of the sheet separator 23 when viewed from a direction A1 in FIG. 6.

As shown in FIG. 7, the sheet separator 23 includes a first driving roller unit U1, a sheet bending unit U2, a second driving roller unit U3, and a stop unit U4.

"Locking" means restricting mutual movement through engagement of one member with another member. "Pressing" means pressing one member against another member. The meaning of "Rotation" includes a circular motion around an axis passing through a centroid of an operation subject itself. The meaning of "Pivoting" includes a circular motion around an axis that does not pass through the centroid of the operation subject itself.

Hereinafter, description will be made using an XYZ coordinate system, as necessary.

A Y direction is a direction along a first shaft 44. One direction in the Y direction is referred to as a +Y direction, and a direction opposite to the +Y direction is referred to as a −Y direction. A Z direction is a direction orthogonal to the Y direction within a plane along the main guide 31 (see FIG. 6). One direction in the Z direction (a direction from the main guide 31 to a tape attacher 107 as shown in FIG. 4) is referred to as a −Z direction, and a direction opposite to the −Z direction is referred to as a +Z direction. The −Z direction is a direction in which the sheet bundle 5 is conveyed (the sheet conveyance direction). The X direction is a direction orthogonal to the Y direction and the Z direction. One direction in the X direction is referred to as a +X direction, and a direction opposite to the +X direction is referred to as a −X direction.

The +Z direction is, for example, a vertically upward direction. The +Z direction may not match the vertically upward direction, and can be a direction including a vertically upward component. In the example shown in FIGS. 2 and 3, the +Z direction is a direction that is not orthogonal to the vertical direction, and includes a vertically upward component.

The first driving roller unit U1 includes a first driving source 51, the first shaft 44, and a first driving roller 41.

The first driving source 51 is, for example, a motor, and rotates the first driving roller 41 via the first shaft 44.

The first shaft 44 is an example of a "first rotation shaft". The first shaft 44 is rotatably supported by bearings 85*a* and 85*a* of the support plates 85 and 85.

The first driving roller 41 is attached to the first shaft 44. The first driving roller 41 is rotatable about the first shaft 44. For example, at least an outer peripheral surface of the first driving roller 41 is formed of ethylene propylene diene rubber (EPDM). A plurality of first driving rollers 41 are provided at different positions in a longitudinal direction of the first shaft 44.

The sheet bending unit U2 includes a clutch 59, a first gear 87, a sheet bending arm 52, a pressing arm 53, a pressing roller 42, a trigger 54, a first force-applying member 57 (see FIGS. 9A and 9B), a second force-applying member 58 (see FIGS. 9A and 9B), a first contact member 55, and a second contact member 56.

The clutch 59 is located between a rotation shaft 51*a* of the first driving source 51 and a first gear 87. The clutch 59 transfers a driving force of the first driving source 51 to the first gear 87 in an ON state. The clutch 59 does not transfer the driving force of the first driving source 51 to the first gear 87 in an OFF state.

Since the clutch 59 transfers the driving force of the first driving source 51 to the sheet bending arm 52 in the ON state and does not transfer the driving force to the sheet bending arm 52 in the OFF state, a connection state between the first driving source 51 and the sheet bending arm 52 can be switched.

The first gear 87 is rotatable independently of the first shaft 44 about the first shaft 44. The first gear 87 transfers the driving force of the first driving source 51 to the sheet bending arm 52.

Figure 9A:
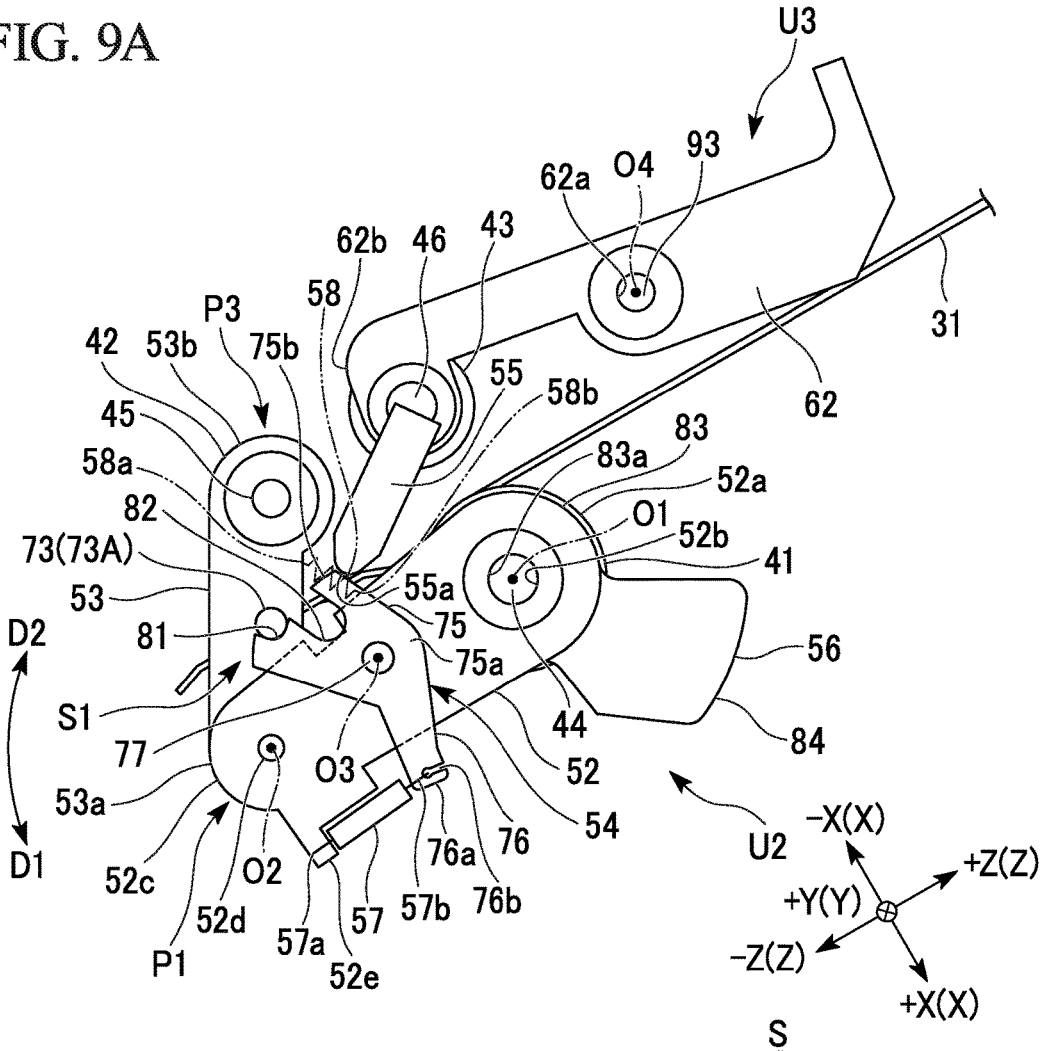
FIG. 9A is a front view showing a portion of a sheet bending unit and a second driving roller unit of the sheet separator according to the embodiment.
Figure 9B:
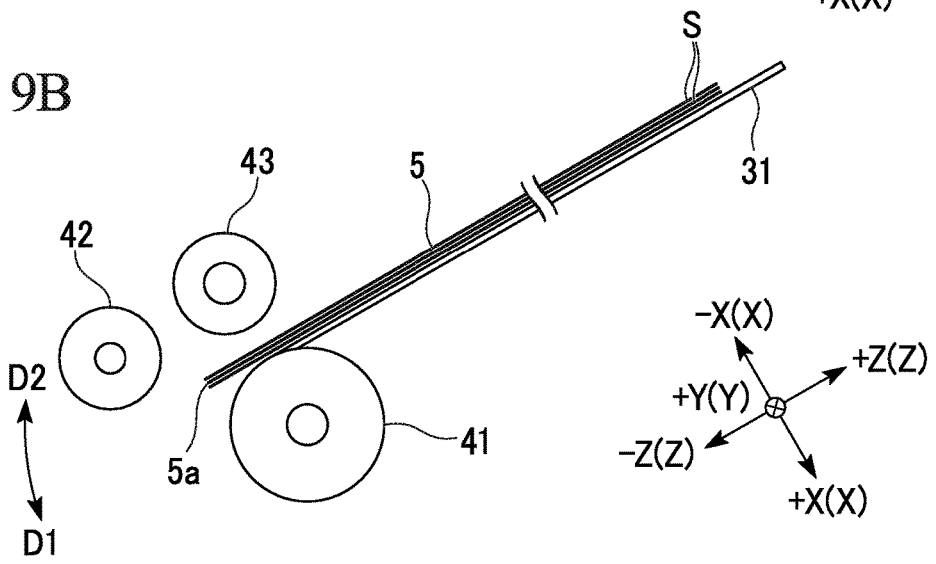
FIG. 9B is a front view showing a portion of a sheet bending unit and a second driving roller unit of the sheet separator according to the embodiment.

FIGS. 9A and 9B are front views showing a portion of the sheet bending unit U2 of the sheet separator 23 and the second driving roller unit U3.

As shown in FIGS. 9A and 9B, the sheet bending arm 52 is, for example, an oval-shaped plate body. A base end insertion hole 52*b* is formed in a base end 52*a* which is one end in a longitudinal direction of the sheet bending arm 52. The first shaft 44 is inserted through the base end insertion hole 52*b*. The sheet bending arm 52 is perpendicular to the first shaft 44, for example.

The sheet bending arm 52 is pivotable independently of the first shaft 44 about the first shaft 44.

A pivoting direction of the sheet bending arm 52 about the first shaft 44 when the sheet bundle 5 is subjected to a bending process is referred to as a first direction D1. A direction opposite to the first direction D1 is referred to as a second direction D2. In FIGS. 9A and 9B, the first direction D1 is a counterclockwise direction, and the second direction is a clockwise direction.

A distal shaft 52*d* that pivotably supports the pressing arm 53 is formed in a distal end 52*c* which is the other end in a longitudinal direction of the sheet bending arm 52. The distal shaft 52*d* is an example of a "second rotation shaft" and is a shaft in the Y direction. A projected attachment portion 52*e* to which one end 57*a* of the first force-applying member 57 is attached is formed in the distal end 52*c* of the sheet bending arm 52.

A shaft 77 that pivotably supports the trigger 54 is formed at an intermediate position in a longitudinal direction of the sheet bending arm 52 (for example, a position between the base end 52*a* and the distal end 52) on an outer surface of the sheet bending arm 52 (a surface opposite to inner surfaces on which the pair of sheet bending arms 52 face each other). The shaft 77 is a shaft in the Y direction.

As shown in FIG. 7, a pair of sheet bending arms 52 and 52 are provided at an interval in a longitudinal direction (Y direction) of the first shaft 44. For example, an elongated plate-shaped connection body 71 bridges between the pair of sheet bending arms 52 and 52. The connection body 71 is provided at a position close to the distal end 52*c* which is the other end in a longitudinal direction of the sheet bending arm 52.

As shown in FIGS. 9A and 9B, the pressing arm 53 is, for example, an oval-shaped plate body. The pressing arm 53 is parallel to, for example, the sheet bending arm 52 (perpendicular to the Y direction). A base end 53*a* that is one end in a longitudinal direction of the pressing arm 53 is pivotably attached to the distal shaft 52*d* (a second rotation shaft) of the sheet bending arm 52.

As shown in FIG. 7, the pair of pressing arms 53 and 53 are provided at an interval in the Y direction. A second shaft 45 having pressing rollers 42 is provided between the pair of pressing arms 53 and 53.

As shown in FIGS. 9A and 9B, the pressing arm 53 is pivotable about the distal shaft 52*d*. With the pivoting of the pressing arm 53, the pressing roller 42 can approach the first driving roller 41 and separate from the first driving roller 41.

As shown in FIGS. 7 and 8, lock projections 73A and 73B (lock portions) are formed on outer surfaces of the pressing arms 53 and 53 (surfaces opposite to inner surfaces on which the pair of pressing arms 53 and 53 face each other) and the inner surfaces. Hereinafter, the lock projections 73A and 73B may be collectively referred to as a lock projection 73.

As shown in FIG. 8, the lock projection 73A is formed to project perpendicularly to the pressing arm 53 outwardly (rightward direction in FIG. 8) from an outer surface (a right surface in FIG. 8) of the pressing arm 53. The lock projection 73B is formed to project perpendicularly to the pressing arm 53 inwardly (leftward direction in FIG. 8) from an inner surface (a left surface in FIG. 8) of the pressing arm 53. The lock projections 73A and 73B have, for example, a pillar shape of which a center axis is perpendicular to the pressing arm 53. The lock projections 73A and 73B are, for example, at overlapping positions when viewed parallel to the Y direction.

As shown in FIG. 7, a plate-shaped sheet bending guide 72 is bridged at a position close to the base end 53*a* between the pair of pressing arms 53 and 53. The second shaft 45 is bridged at a position close to the distal end 53*b* between the pair of pressing arms 53 and 53. The second shaft 45 is arranged in the Y direction.

The pressing roller 42 is provided on the second shaft 45. The pressing roller 42 is rotatable about the second shaft 45. For example, at least an outer peripheral surface of the pressing roller 42 is formed of ethylene propylene diene rubber (EPDM). A plurality of pressing rollers 42 are provided at different positions in a longitudinal direction of the second shaft 45. The pressing roller 42 is an example of a "pressing body".

Figure 10A:
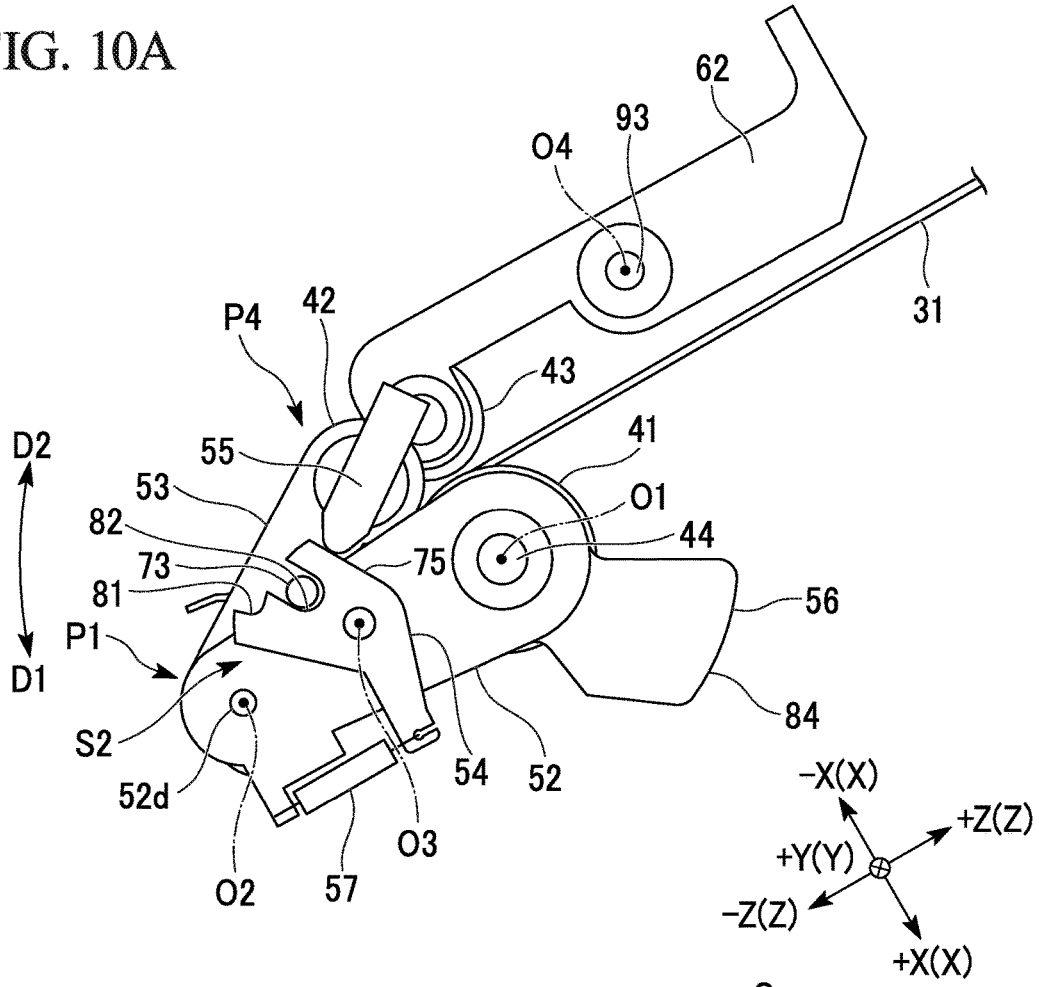
FIG. 10A is a front view showing an operation of the sheet separator of the embodiment.
Figure 10B:
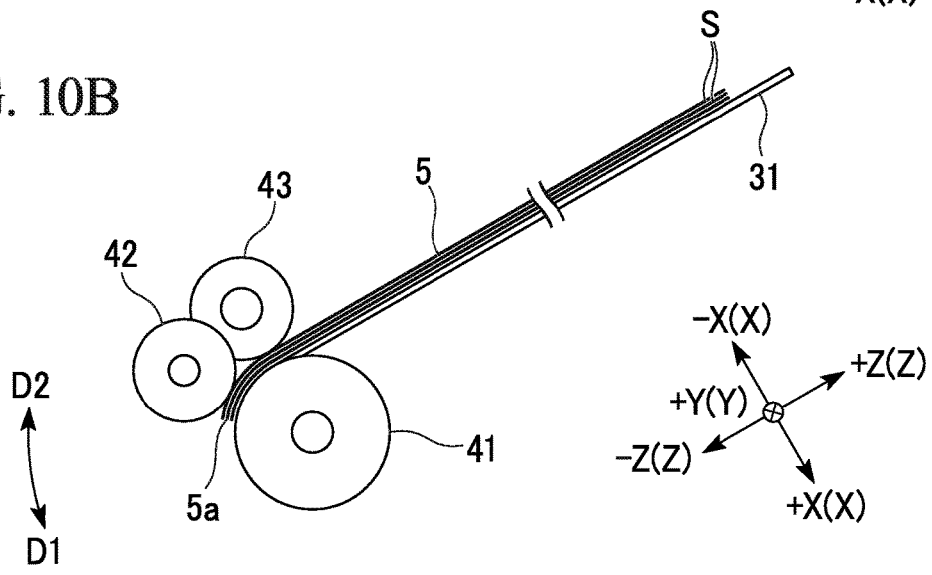
FIG. 10B is a front view showing the operation of the sheet separator of the embodiment.

Through the pivoting of the pressing arm 53, the pressing roller 42 can be switched between a non-pressing position P3 in which the sheet bundle 5 is not pressed toward to the first driving roller 41 (see FIGS. 9A and 9B) and a pressing position P4 in which the sheet bundle 5 is pressed toward the first driving roller 41 (see FIGS. 10A and 10B).

The pressing roller 42 may not be rotatable relative to the pressing arm 53.

As shown in FIGS. 9A and 9B, the trigger 54 is formed in a plate shape. The trigger 54 is, for example, parallel to the sheet bending arm 52 and is arranged along an outer surface of the sheet bending arm 52. The trigger 54 is pivotably attached to the shaft 77 of the sheet bending arm 52.

As shown in FIGS. 9A and 9B, the trigger 54 is a plate-shaped body including a plate-shaped main portion 75 and an extension portion 76 extending from a base end 75*a* of the main portion 75.

A first lock receiver 81 and a second lock receiver 82 by which the lock projection 73 (73A) can be locked are formed in an edge of the distal end 75*b* of the main portion 75.

The first lock receiver 81 is a recessed portion formed in a recessed shape from the distal end 75*b* to the base end 75*a*, and the lock projection 73 (73A) of the pressing arm 53 can enter the first lock receiver 81 and be locked.

The second lock receiver 82 is a recessed portion formed in a recessed shape from the distal end 75*b* to the base end 75*a*, and the lock projection 73 (73A) of the pressing arm 53 can enter the second lock receiver 82 and be locked.

The second lock receiver 82 is formed to be deeper than the first lock receiver 81. The first lock receiver 81 and the second lock receiver 82 are formed adjacent to each other.

A recessed attachment portion 76*b* to which the other end 57*b* of the first force-applying member 57 is attached is formed in a distal end 76*a* of the extension portion 76.

The trigger 54 can be switched between a first posture 51 in which the lock projection 73 (73A) is locked into the first lock receiver 81 (see FIGS. 9A and 9B) and a second posture S2 in which the lock projection 73 (73A) is locked into the second lock receiver 82 (see FIGS. 10A and 10B) through the pivoting about the shaft 77.

As shown in FIG. 7, the trigger 54 is provided on outer surfaces of the pair of sheet bending arms 52 and 52 (surfaces opposite to inner surfaces on which the pair of sheet bending arms 52 and 52 face each other).

As shown in FIGS. 9A and 9B, a center of the first shaft 44 is referred to as a "axis O1". A center of the distal shaft 52*d* is referred to as a "axis O2". A center of the shaft 77 is referred to as a "axis O3". A center of a fifth shaft 93 to be described below is referred to as a "axis O4".

The first contact member 55 is formed in a long plate shape. A distal end 55*a* of the first contact member 55 comes into contact with the main portion 75 of the trigger 54 when the sheet bending arm 52 is at a bending process start position P 1 (first position).

The pair of first contact members 55 are arranged, for example, on the outer surface sides of the sheet bending arms 52 and 52, respectively.

The second contact member 56 is a plate-shaped body. The second contact member 56 is parallel to the sheet bending arm 52, for example. As shown in FIGS. 7 and 8, the pair of second contact members 56 and 56 are arranged, for example, on the inner surface sides of the sheet bending arms 52 and 52, respectively. The second contact member 56 is a plate-shaped body including a circular main portion 83, and a polygonal projection 84 that projects from the main portion 83 (see FIGS. 11A and 11B).

As shown in FIGS. 9A and 9B, a main-portion insertion hole 83*a* into which the first shaft 44 is inserted is formed at a center of the main portion 83.

Figure 11A:
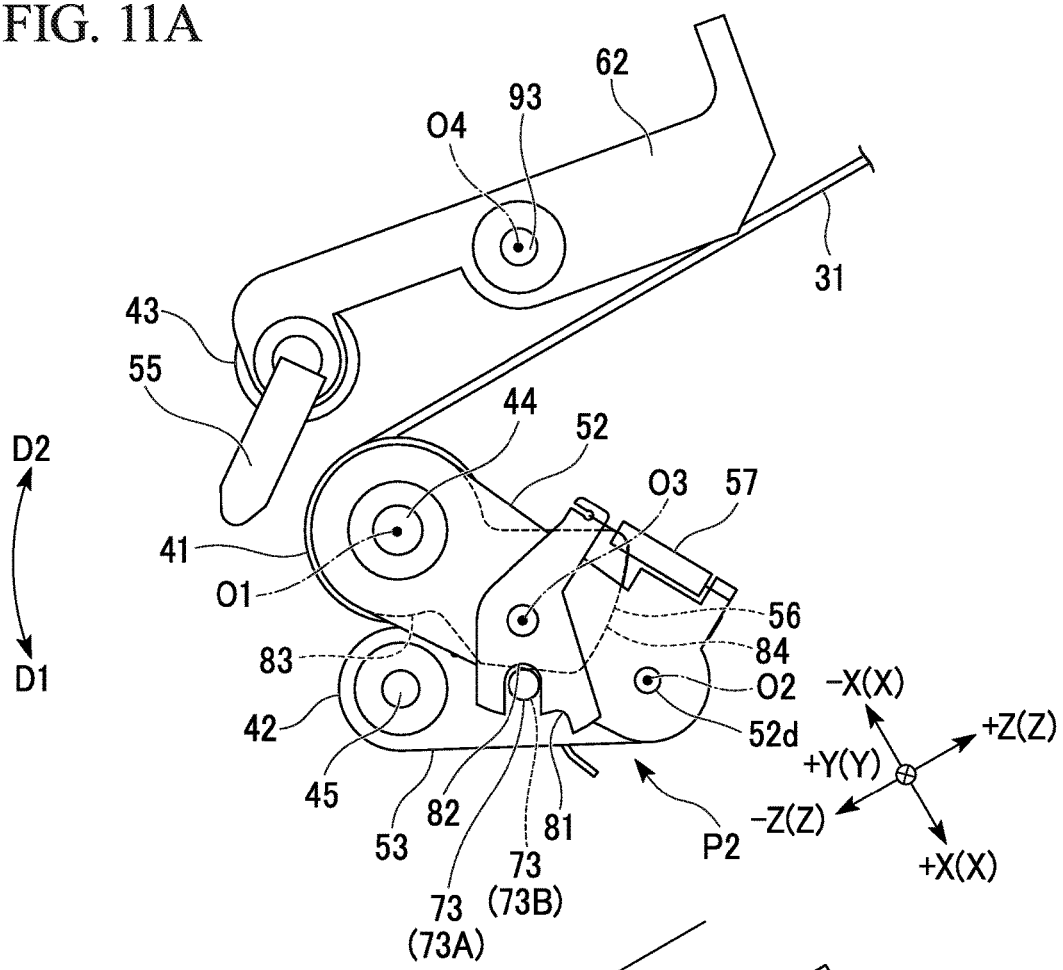
FIG. 11A is a front view showing the operation of the sheet separator of the embodiment.
Figure 11B:
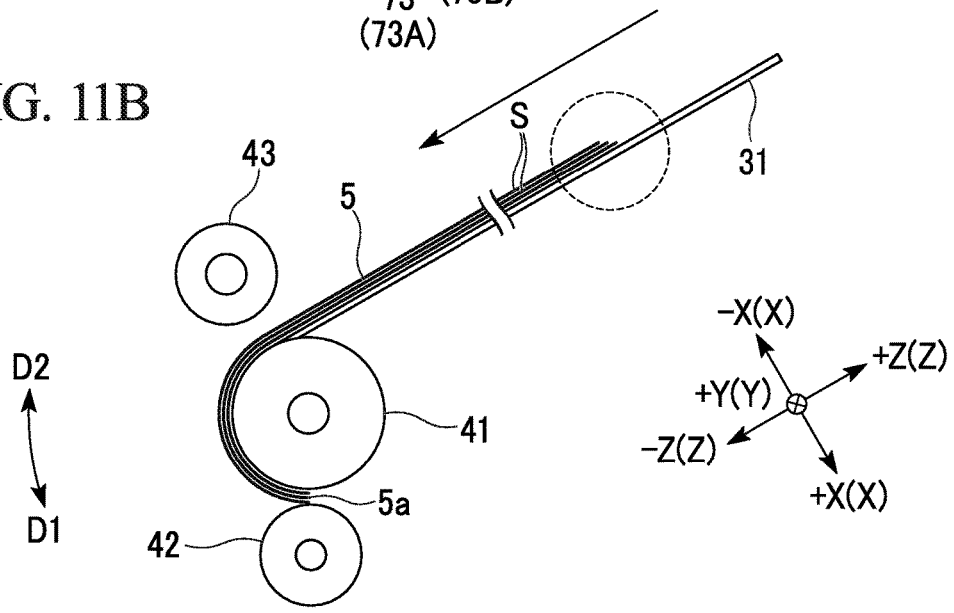
FIG. 11B is a front view showing the operation of the sheet separator of the embodiment.

The projection 84 of the second contact member 56 comes into contact with the lock projection 73 (73B) when the sheet bending arm 52 is at an end position P2 (second position) of the bending process (see FIGS. 11A and 11B). The sheet bending arm 52 is movable between the first position P2 and the second position P2 in the first direction.

As shown in FIG. 7, the first contact member 55 and the second contact member 56 are provided on the attachment plate 95 and positions thereof are fixed within the sheet separator 23.

As shown in FIGS. 9A and 9B, one end 57*a* of the first force-applying member 57 is attached to a projected attachment portion 52*e* of the sheet bending arm 52. The other end 57*b* of the first force-applying member 57 is attached to the recessed attachment portion 76*b* of the extension portion 76 of the trigger 54.

The first force-applying member 57 applies a force to the trigger 54 against the sheet bending arm 52 in a direction in which the lock projection 73 (73A) is locked by the first lock receiver 81.

One end 58*a* of the second force-applying member 58 is attached to the pressing arm 53 and the other end 58*b* thereof is attached to the sheet bending arm 52.

The second force-applying member 58 applies a force to the pressing arm 53 to the sheet bending arm 52 in a direction in which the pressing roller 42 (see FIG. 9B) is arranged at the pressing position P4 (see FIGS. 10A and 10B).

As shown in FIG. 7, the second driving roller unit U3 includes a second driving source 61, a second driving roller arm 62, a third shaft 46, and a second driving roller 43 (pressing roller).

The second driving source 61 is, for example, a motor and pivots the fifth shaft 93. The fifth shaft 93 is rotatably supported by bearings 86*a* and 86*a* of the support plates 86 and 86.

As shown in FIG. 7, the second driving roller arm 62 has a long plate shape, and is pivotable about the fifth shaft 93 inserted into an insertion hole 62*a* (see FIGS. 9A and 9B) formed at an intermediate position in a longitudinal direction.

The third shaft 46 is bridged between the pair of second driving roller arms 62 and 62.

The third shaft 46 is provided at a distal end 62*b* which is one end in the longitudinal direction of the second driving roller arm 62.

The second driving roller 43 is attached to the third shaft 46 and rotates, for example, according to rotation of the first driving roller 41. A plurality of second driving rollers 43 are provided at different positions in a longitudinal direction of the third shaft 46.

The second driving roller 43 is capable of approaching the first driving roller 41 and separating from the first driving roller 41. When the second driving roller 43 approaches the first driving roller 41, the second driving roller 43 can press the sheet bundle 5 against the first driving roller 41.

As shown in FIG. 7, the stop unit U4 includes a stopper mechanism 60 having a second gear 88, a lock plate 89, and a lock plate stopper 90.

The second gear 88 is attached to the fourth shaft 91 in the Y direction and rotates about the fourth shaft 91. The second gear 88 engages with the first gear 87.

The lock plate 89 has a disk shape with a notch 89*a* in a portion of a peripheral edge thereof. The lock plate 89 is attached to the fourth shaft 91 and rotates about the fourth shaft 91. The lock plate 89 is coupled to the sheet bending arm 52.

The fourth shaft 91 is rotatably supported by the bearings 86*b* and 86*b* of the support plates 86 and 86 and the bearings 85*b* and 85*b* of the support plates 85 and 85.

The lock plate stopper 90 includes a lock member 90*a* that is locked to the notch 89*a* of the lock plate 89. By a force-applying member (not shown in the figure) such as a spring, a force is applied to the lock member 90*a* in a direction approaching the lock plate 89.

The lock plate stopper 90 restricts the rotation of the lock plate 89 by locking the lock member 90*a* to the notch 89*a* of the lock plate 89. Accordingly, the rotation of the second gear 88 and the first gear 87 is restricted, and the pivoting of the sheet bending arm 52 is restricted. Therefore, even when the clutch 59 is OFF, it is possible to prevent the sheet bending arm 52 from pivoting due to its own weight.

As shown in FIG. 4, the sheet binding device 24 includes a tape supply mechanism 100, a tape holder 104, and a tape attacher 107.

The tape supply mechanism 100 includes an unwinder 33, a tape conveyance roller 34 (tape feeding portion), a separation member 35, a winder 36, a tape support base 37, and a cutter 38.

The unwinder 33 holds, for example, a raw fabric roll on which a band-shaped tape T (hereinafter simply referred to as a "tape T") has been wound. The unwinder 33 supplies the tape T in a longitudinal direction of the tape T.

The tape T includes an adhesive layer 47, a protective film 48, and a peelable film 49. The protective film 48 covers the adhesive layer 47. The protective film 48 is formed integrally with the adhesive layer 47 when the tape T is used. The peelable film 49 covers the adhesive layer 47 from the side opposite to the protective film 48. The peelable film 49 is peeled from the adhesive layer 47 before the tape T is used. The peelable film 49 is wound by the winder 36 via the separation member 35.

The tape conveyance roller 34 conveys the tape T supplied from the unwinder 33 toward the tape support base 37 in a longitudinal direction of the tape T. The tape support base 37 guides the tape T from which the peelable film 49 has been separated, onto an upper surface 37*a*.

The cutter 38 moves in the Y direction by a driving mechanism, which is not shown in the figure, to cut the tape T on the tape support base 37 to a predetermined length. For example, the cutter 38 is a rotor cutter. The cutter 38 is movable in a direction approaching the tape T and a direction in which the cutter 38 becomes far from the tape T by a moving mechanism, which is not shown in the figure.

A tape attacher 107 (tape processor) includes a first roller 101, a second roller 102, and a support member 103 that supports the first roller 101 and the second roller 102. By a force-applying member, a force is applied to the first roller 101 toward the second roller 102.

Next, an example of an operation of the sheet post-processing device 1 will be described.

As shown in FIG. 4, the tape conveyance roller 34 conveys the tape T supplied from the unwinder 33. In the tape T, the peelable film 49 is separated by the separation member 35 and the adhesive layer 47 is arranged on the upper surface 37*a* of the tape support base 37 in a state in which the adhesive layer 47 is exposed on the upper surface side.

The sheet post-processing device 1 holds the tape T on the tape support base 37 by use of the holding bars 112 and 112 of the tape holder 104. The tape T is cut to a predetermined length by the cutter 38 to obtain a tape section T1. By use of the tape holder 104, the tape section T1 moves between the sheet separator 23 and the tape attacher 107. For example, the tape holder 104 arranges the tape section T1 to straddle the first roller 101 and the second roller 102.

FIGS. 9A to 14B are front views showing an example of the operation of the sheet separator 23 in an order of steps. FIGS. 9A, 10A, 11A, 12A, 13A, and 14A mainly show operations of the sheet bending arm 52, the pressing arm 53, and the trigger 54. FIGS. 9B, 10B, 11B, 12B, 13B, and 14B show operations of the first driving roller 41, the pressing roller 42, the second driving roller 43, and the sheet bundle 5.

In an initial state (a state in which the sheet bundle 5 has been formed) shown in FIGS. 9A and 9B, the trigger 54 takes a first posture 51 and the lock projection 73 (73A) is locked into the first lock receiver 81. Accordingly, the pressing roller 42 is at a non-pressing position P3. The second driving roller 43 is spaced apart from the first driving roller 41.

The sheet bending arm 52 takes a posture in which a longitudinal direction is substantially directed to a direction along the main guide 31.

If the stopper 32 (see FIG. 4) is arranged at a restriction position to restrict the movement of the sheet S on the main guide 31, the sheet bundle 5 is formed in a state in which the edges 5*a* are aligned.

The distal end 55*a* of the first contact member 55 comes into contact with the main portion 75 of the trigger 54. A position of the sheet bending arm 52 at this time is referred to as a start position P1 of the bending process.

As shown in FIGS. 10A and 10B, the second driving roller arm 62 is pivoted by the second driving source 61 (see FIG. 7), and the sheet bundle 5 is pressed against the first driving roller 41 by the second driving roller 43. In this case, the first driving roller 41 is driven by the first driving source 51 (see FIG. 7) so as to adjust a position in the conveyance direction of the sheet bundle 5, as necessary.

If the clutch 59 is ON and the sheet bending arm 52 is pivoted in the second direction D2 about an axis O1 (the first shaft 44) by the first driving source 51 (see FIG. 7), the main portion 75 of the trigger 54 is pressed against the first contact member 55, and the trigger 54 pivots about an axis O3 (the shaft 77) (counterclockwise in FIGS. 10A and 10B).

The first lock receiver 81 is disengaged from the lock projection 73 (73A), and the pressing arm 53 is pivoted about the axis O2 (the distal shaft 52*d*) (clockwise in FIGS. 10A and 10B) by a biasing force of the second force-applying member 58 (see FIGS. 9A and 9B)), and the trigger 54 takes a posture (second posture S2) in which the second lock receiver 82 is locked into the lock projection 73 (73A). Accordingly, the pressing roller 42 moves in a direction approaching the first driving roller 41 and presses the sheet bundle 5 against the first driving roller 41.

As shown in FIGS. 11A and 11B, the second driving roller arm 62 is pivoted about the axis O4 (fifth shaft 93) and the second driving roller 43 is separated from the sheet bundle 5. Thus, in a state in which the sheet bundle 5 is not constrained by the second driving roller 43, the first driving roller 41 is rotated in the first direction D1 and the sheet bending arm 52 is pivoted in the first direction D1. In this case, the pressing roller 42 pivots about the axis O1 in the first direction D1 together with the sheet bending arm 52, and maintains a state in which the sheet bundle 5 is pressed against the first driving roller 41.

A process of bending the sheet bundle 5 in the first direction D1 as shown in FIGS. 9A to 11B is referred to as a "bending process".

In a state shown in FIGS. 11A and 11B, the sheet bending arm 52 is at an end position P2 of the bending process, and the lock projection 73 (73B) comes into contact with the projection 84 of the second contact member 56.

Since the sheet bundle 5 is pressed by the pressing roller 42 and pivoted in the first direction D1 in a state in which the edges 5*a* are aligned, a displacement d is caused between the sheets S according to a thickness t of the sheet S. If a rotation angle in the first direction D1 of the first driving roller 41 (a pivoting angle in the first direction D1 of the sheet bending arm 52) is θ, the displacement d may be expressed by Equation (1) below.

$$d=\theta\cdot t \tag{1}$$

Figure 12A:
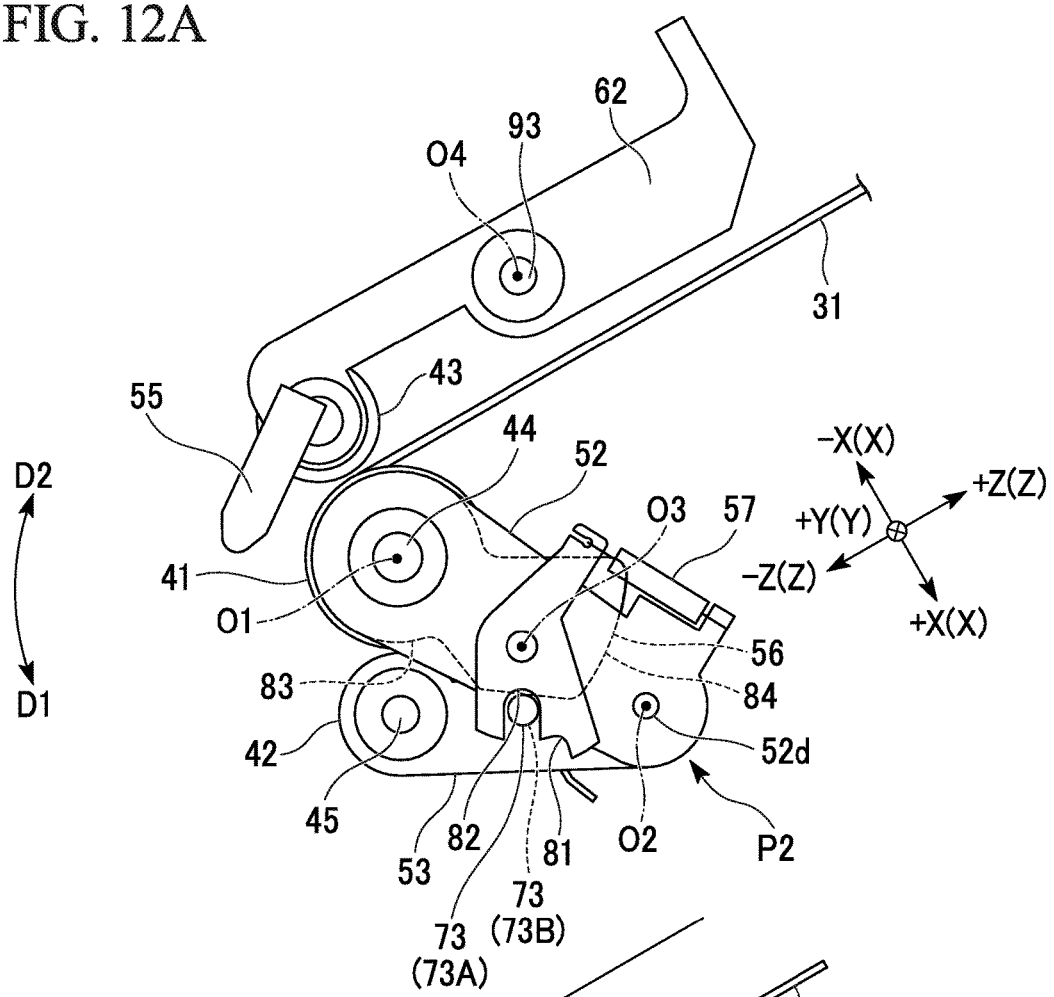
FIG. 12A is a front view showing the operation of the sheet separator of the embodiment.
Figure 12B:
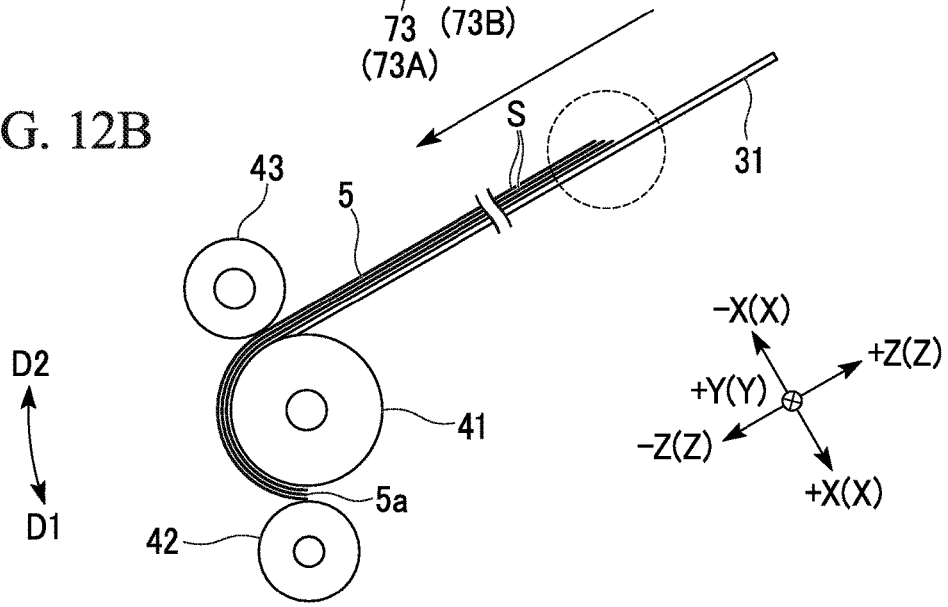
FIG. 12B is a front view showing the operation of the sheet separator of the embodiment.

As shown in FIGS. 12A and 12B, the second driving roller arm 62 is pivoted, and the sheet bundle 5 is pressed against the first driving roller 41 by the second driving roller 43.

Figure 13A:
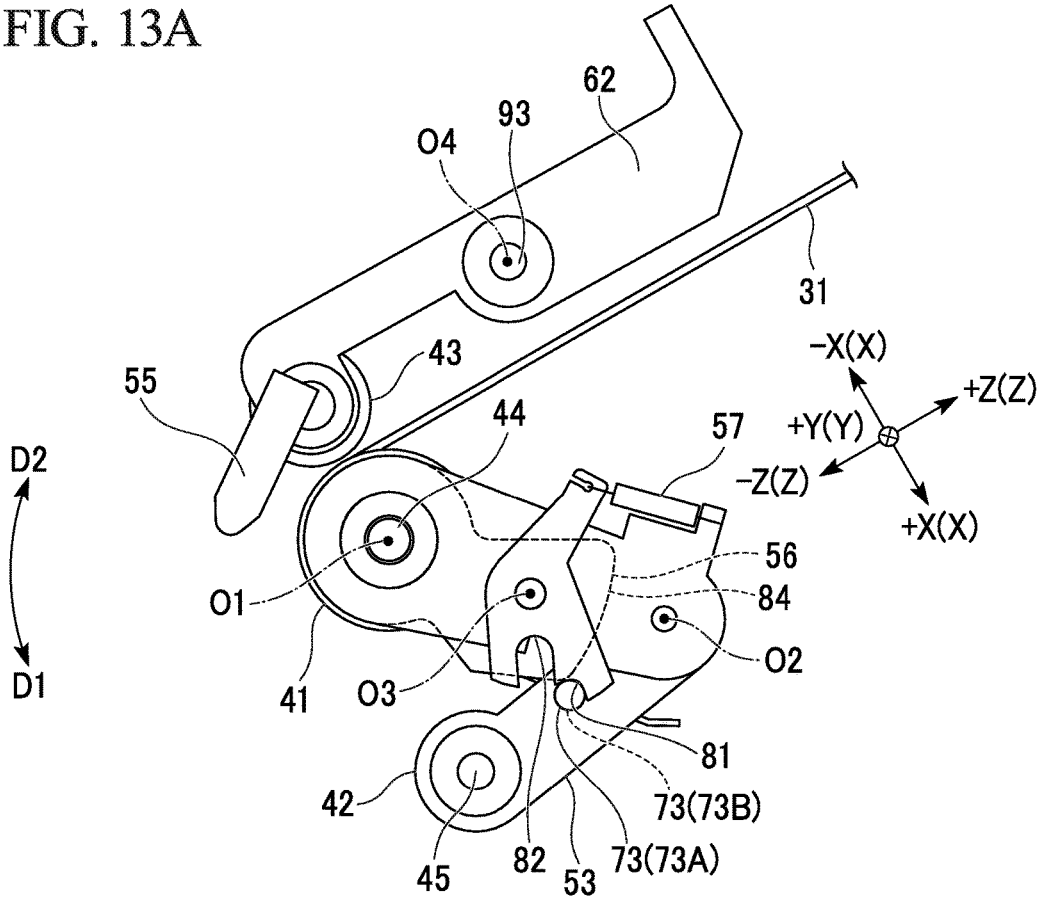
FIG. 13A is a front view showing the operation of the sheet separator of the embodiment.
Figure 13B:
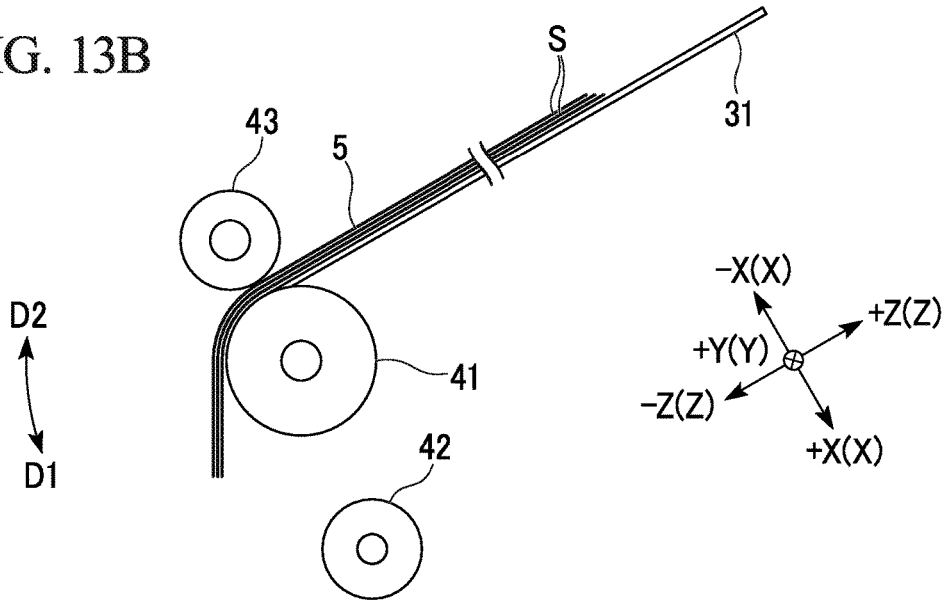
FIG. 13B is a front view showing the operation of the sheet separator of the embodiment.

As shown in FIGS. 13A and 13B, if the sheet bending arm 52 is further pivoted in the first direction D1 in a state in which the lock projection 73 (73B) comes into contact with the projection 84 of the second contact member 56, a force is applied to the lock projection 73 (73B) so that the pressing arm 53 is pivoted about the axis O2 (counterclockwise FIGS. 13A and 13B) relative to the sheet bending arm 52 by the projection 84.

Accordingly, the pressing arm 53 relatively moves in a direction in which the lock projection 73 (73A) is disengaged from the second lock receiver 82. The trigger 54 returns to the posture (first posture 51) in which the first lock receiver 81 is locked into the lock projection 73 (73A) by the biasing force of the first force-applying member 57.

The projection 84 of the second contact member 56 has a shape by which the lock projection 73 (73A) is not disengaged from the trigger 54 even when the sheet bending arm 52 is pivoted in the first direction D1 from this state.

The pressing arm 53 pivots about the axis O2 (counterclockwise in FIGS. 13A and 13B) relative to the sheet bending arm 52, and accordingly, the pressing roller 42 is separated from the sheet bundle 5. Accordingly, the restraint by the pressing roller 42 is released. In this case, since the sheet bundle 5 is pressed by the second driving roller 43, the sheet bundle 5 does not move due to its own weight.

Figure 14A:
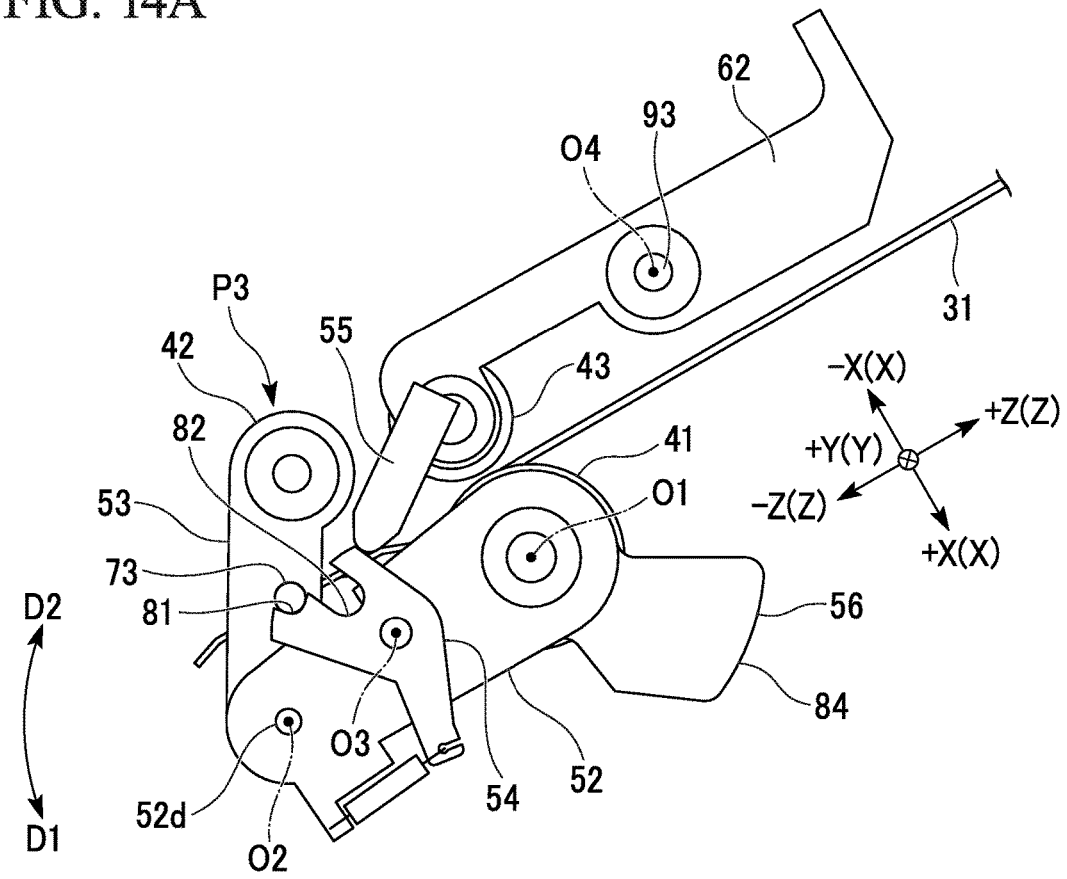
FIG. 14A is a front view showing the operation of the sheet separator of the embodiment.
Figure 14B:
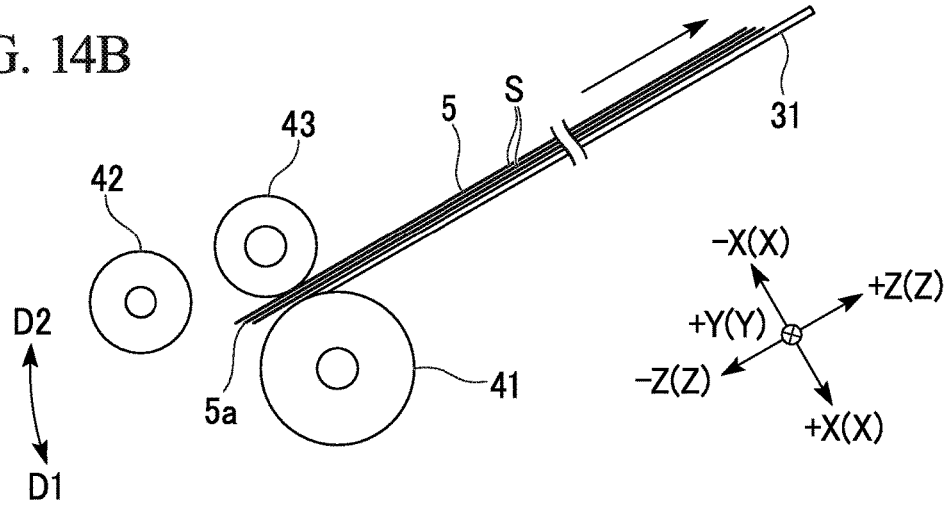
FIG. 14B is a front view showing the operation of the sheet separator of the embodiment.

As shown in FIGS. 14A and 14B, the first driving roller 41 and the sheet bending arm 52 are pivoted in the second direction D2 about the axis O1. Thus, the pressing roller 42 returns to an initial state in a state in which the pressing roller 42 is separated from the sheet bundle 5, and accordingly, the sheet bundle 5 returns to an unbent state while displacement is caused between the sheets S.

It is also possible to increase the displacement among the sheets S by repeating the bending process shown in FIGS. 9A to 14B a plurality of times.

If the sheet bending arm 52 is pivoted, the lock plate 89 is rotated via the first gear 87 and second gear 88 shown in FIG. 7. If the sheet bending arm 52 is pivoted to the position shown in FIGS. 14A and 14B, the lock member 90*a* of the lock plate stopper 90 shown in FIG. 7 is locked into the notch 89*a* of the lock plate 89. In this state, the clutch 59 is turned OFF.

The rotation of the first gear 87 is restricted due to the lock member 90*a* of the lock plate stopper 90 being locked into the notch 89*a* of the lock plate 89 as shown in FIG. 7. Accordingly, the sheet bending arm 52 maintains its posture even when the clutch 59 is turned OFF.

FIGS. 15 to 18 are front views showing an operation example of the sheet separator 23 in an order of steps.

Figure 15:
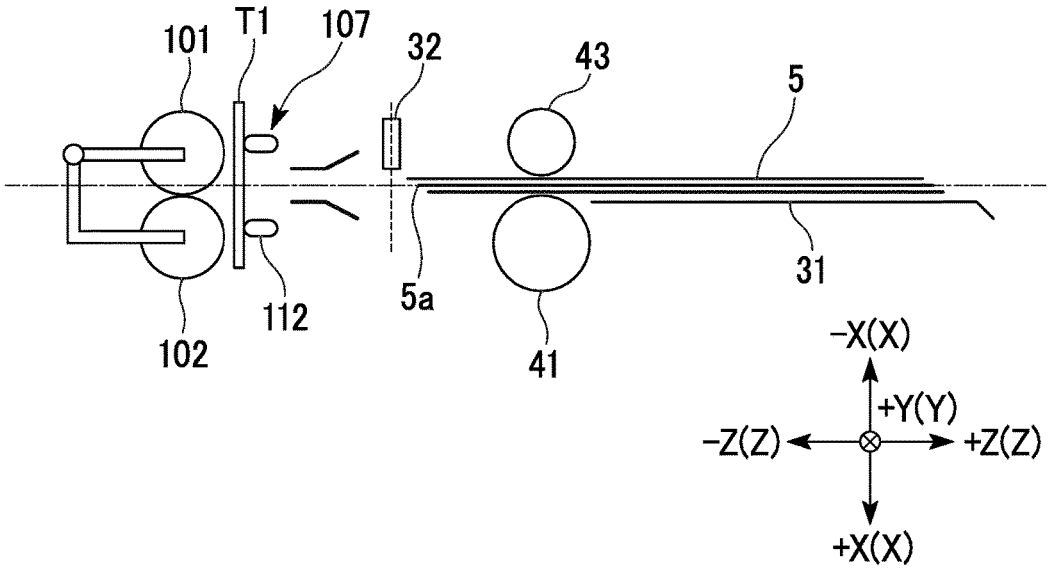
FIG. 15 is a front view schematically showing an operation of the sheet post-processing device having the sheet separator of the embodiment.

As shown in FIG. 15, the stopper 32 moves to a release position to ensure a conveyance path of the sheet bundle 5 towards the tape attacher 107.

Figure 16:
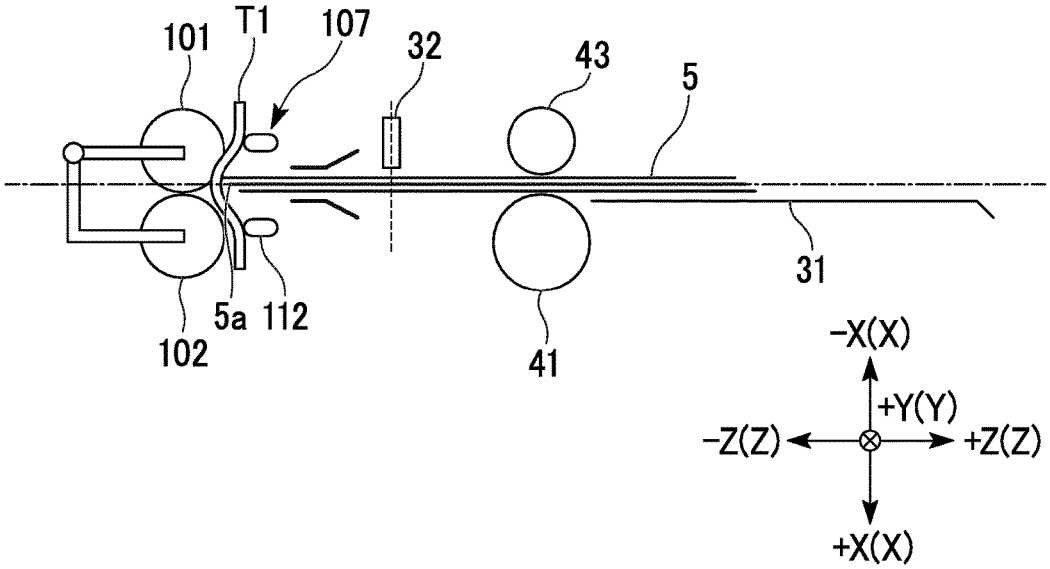
FIG. 16 is a front view showing an operation of the sheet post-processing device having the sheet separator of the embodiment.

As shown in FIG. 16, the first driving roller 41 and the second driving roller 43 are forward rotated to move the sheet bundle 5 toward the tape attacher 107. An end of the edge 5*a* of the sheet bundle 5 is abutted on the tape section T1 and the edge 5*a* of the sheet bundle 5 is inserted between the first roller 101 and the second roller 102 together with the tape section T1.

Figure 17:
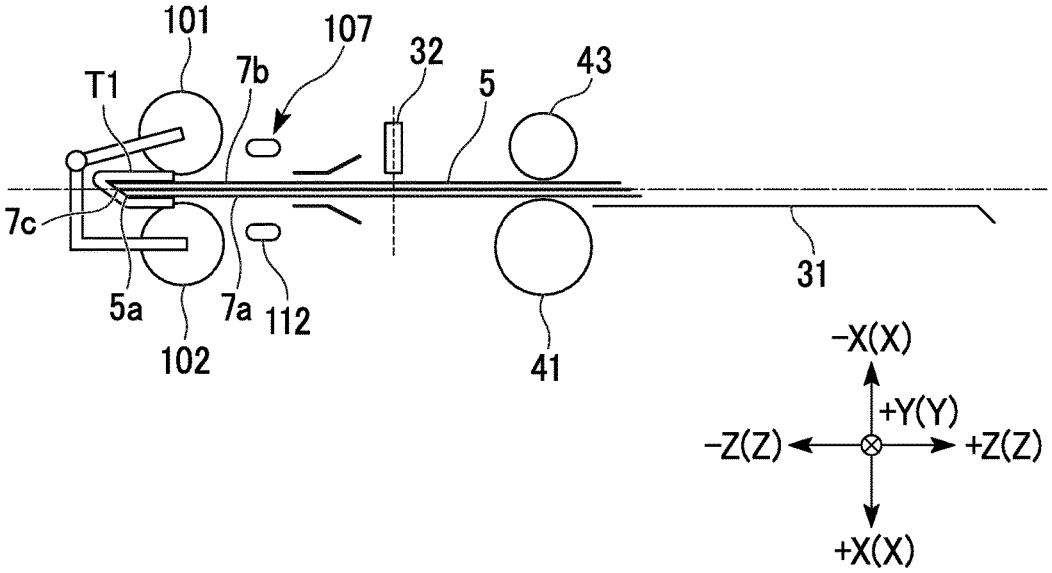
FIG. 17 is a front view showing an operation of the sheet post-processing device having the sheet separator of the embodiment.

If the edge 5*a* of the sheet bundle 5 is inserted between the first roller 101 and the second roller 102 together with the tape section T1 as shown in FIG. 17, the first roller 101 and the second roller 102 are pressed against the sheet bundle 5 and move in a direction in which the first roller 101 and the second roller 102 are separated from each other. Thus, the first roller 101 and the second roller 102 press the tape section T1 against the edge 5*a* of the sheet bundle 5. As a result, the tape section T1 sequentially comes into close contact with a step-shaped portion of the edge 5*a* of the sheet bundle 5 in a follow-up manner.

The edge 5*a* of the sheet bundle 5 includes a first surface 7*a*, a second surface 7*b*, and an end surface 7*c*. The first surface 7*a* and the second surface 7*b* are surfaces in the sheet conveyance direction. The second surface 7*b* is located on the side opposite to the first surface 7*a*. The end surface 7*c* is located between the first surface 7*a* and the second surface 7*b*, and a plurality of sheets S are displaced in a stepwise manner. The sheet S is attached over the first surface 7*a*, the end surface 7*c*, and the second surface 7*b* at the edge 5*a* of the sheet bundle 5. Thus, all the sheets S including intermediate pages of the sheet bundle 5 are integrally integrated by the tape section T1. Accordingly, the process of attaching the tape section T1 to the edge 5*a* of the sheet bundle 5 is completed.

Figure 18:
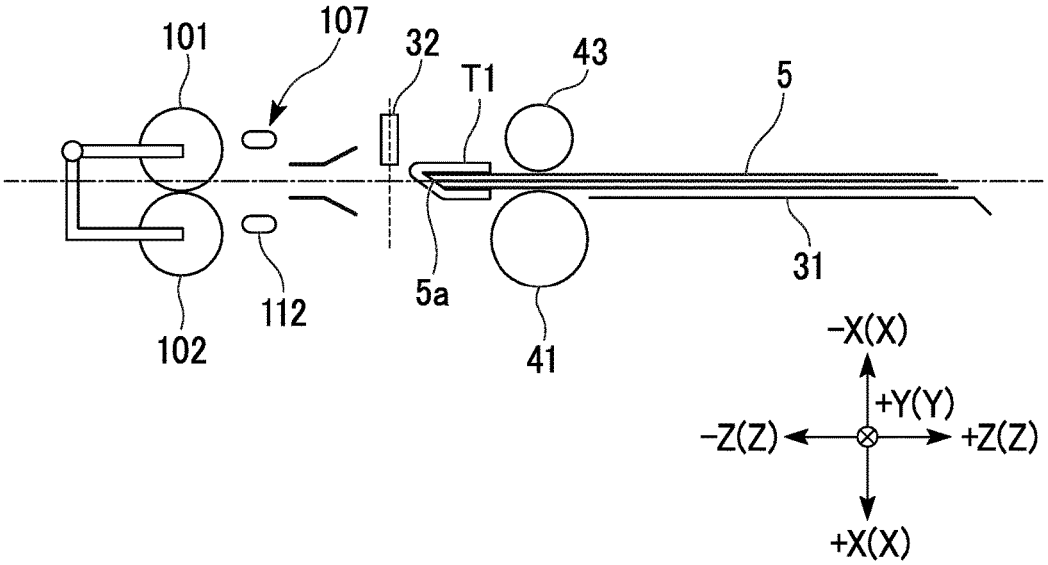
FIG. 18 is a front view showing an operation of the sheet post-processing device having the sheet separator of the embodiment.

Next, the first driving roller 41 and the second driving roller 43 are reversely rotated to take out the sheet bundle 5 from between the first roller 101 and the second roller 102, as shown in FIG. 18. The first driving roller 41 and the second driving roller 43 are further reversely rotated, such that the sheet bundle 5 can be discharged to the discharger of the sheet post-processing device 1 shown in FIG. 1.

Thus, a series of operations performed by the sheet post-processing device 1 are completed.

The sheet bundle 5 is reciprocated a plurality of times in a Z-direction, such that the tape portion (a portion in which the tape section T1 is attached) can be pressed by the rollers 101 and 102 a plurality of times. Thus, the tape section T1 can be brought into close contact with the sheet bundle 5 and the sheet bundle 5 can be reliably bound.

Further, the tape portion of the sheet bundle 5 can be kept in a state in which the tape portion is pressed by the rollers 101 and 102 for a certain time. Thus, the tape section T1 can be brought into close contact with the sheet bundle 5, and the sheet bundle 5 can be reliably bound.

According to the sheet separator 23, the first driving roller 41 is rotated in the first direction D1 in a state in which the sheet bundle 5 is sandwiched by the first driving roller 41 and the pressing roller 42, to perform the bending process on the sheet bundle 5. Thus, the sheet bundle 5 can be displaced at the edge 5*a*.

In the sheet separator 23, since the first driving roller 41 that conveys the sheet bundle 5 can be used for the process of bending the sheet bundle 5, that is, the first driving roller 41 can be used for both of the process of bending the sheet bundle 5 and the conveyance, the process of causing the sheet bundle 5 to be displaced at the edge 5*a* and the conveyance of the sheet bundle 5 can be realized by a smaller number of driving sources and a simple mechanism. Therefore, it is possible to reduce a size of the device. Further, since the number of the driving sources is small, it is possible to suppress power consumption and reduce a cost.

Since the sheet separator 23 can cause the sheet bundle 5 to be displaced at the edge 5*a* through the process of bending the sheet bundle 5, it is possible to obtain an amount of displacement of the sheets S necessary to ensure an adhesion force of the tape T. Further, when the sheets S constituting the sheet bundle 5 are thin, it is possible to ensure a necessary amount of displacement of the sheets S, for example, in a case in which the number of sheets S is small.

As described above, in the sheet separator 23, the first driving roller 41 and the sheet bending arm 52 are operated in the first direction D1 in a state in which the pressing roller 42 moves to the pressing position P4, to perform the process of bending the sheet bundle 5 and cause displacement in the edges 5*a* of the sheet bundle 5. On the other hand, the first driving roller 41 and the sheet bending arm 52 are operated in the second direction D2 in a state in which the pressing roller 42 moves to the non-pressing position P3, such that the sheet bundle 5 can return to a conveyance position while maintaining the displacement of the edges 5*a*.

According to the sheet separator 23, the trigger 54 can be switched between the first posture S1 in which the lock projection 73 is locked into the first lock receiver 81 and the second posture S2 in which the lock projection 73 is locked into the second lock receiver 82 according to a pivoting position of the sheet bending arm 52. The pressing roller 42 is at the non-pressing position P3 when the lock projection 73 is locked into the first lock receiver 81 and at the pressing position P4 when the lock projection 73 is locked into the second lock receiver 82.

Therefore, the pressing roller 42 can be switched between the non-pressing position P3 and the pressing position P4 according to the pivoting position of the sheet bending arm 52. Since it is not necessary to provide a driving source for moving the pressing roller 42 between the pressing position P4 and the non-pressing position P3, it is possible to perform the process of bending the sheet bundle 5 with a simple mechanism without increasing the number of driving sources. Therefore, it is possible to reduce a size of the device. Further, it is possible to suppress power consumption and reduce a cost.

In the sheet separator 23, since the trigger 54 and the pressing arm 53 are operated by the first contact member 55 and the second contact member 56 to move the pressing roller 42 between the pressing position P4 and the non-pressing position P3, it is possible to perform the process of bending the sheet bundle 5 with a simple mechanism without increasing the number of driving sources. Therefore, it is possible to reduce a size of the device. Further, it is possible to suppress power consumption and reduce a cost.

Since the sheet separator 23 includes the second driving roller 43 that holds the sheet bundle 5 with the sheet bundle 5 sandwiched between the second driving roller 43 and the first driving roller 41, it is possible to hold the sheet bundle 5 in a state in which displacement is caused in the edges 5*a* by moving the pressing roller 42 to the non-pressing position P3 in a state in which the sheet bundle 5 is pressed by the second driving roller 43.

The sheet separator 23 includes the clutch 59 that switches a connection state between the first driving source 51 and the sheet bending arm 52. Therefore, when the process of bending the sheet bundle 5 is performed, the first driving roller 41 and the sheet bending arm 52 can be operated by the first driving source 51, and when the sheet bundle 5 is conveyed, only the first driving roller 41 can be operated and the sheet bending arm 52 is not operated. Thus, it is possible to realize the bending process and the conveyance of the sheet bundle 5 with a small number of driving sources (basically only the first driving source 51).

Since the sheet separator 23 includes the lock plate 89 and the lock plate stopper 90 that is locked into the lock plate 89, it is possible to prevent the sheet bending arm 52 from operating due to its own weight when the clutch 59 is turned OFF.

Since the sheet post-processing device 1 that is a sheet post-processing device that performs post-processing on the sheet S conveyed from the image former 2 includes the sheet separator 23, it is possible to reduce a size and a cost of the device, as described above.

Since the image forming apparatus 3 includes the sheet separator 23 of this embodiment, it is possible to reduce a size and a cost of the device, as described above.

Since the sheet separator 23 can perform the bending process on the sheet bundle 5 and cause the sheet bundle 5 to be displaced at the edge 5*a*, the sheet separator 23 can be appropriately applied to binding of the sheet bundle 5, but the application of the sheet separator 23 is not limited to binding of the sheet bundle 5. For example, the sheet separator 23 can be used as a separator for the sheets S for fast and stable conveyance of the sheets S in the image forming apparatus 3. Specifically, for example, in the image forming apparatus 3, the sheet separator 23 can be applied to the sheet feeder 14 for feeding the sheets S.

The configuration of the embodiment is not limited to the above example. For example, the sheet post-processing device 1 may be an independently used device regardless of the image former 2.

According to at least one embodiment described above, the first driving roller 41 is rotated in the first direction D1 in a state in which the sheet bundle 5 is sandwiched by the first driving roller 41 and the pressing roller 42, to perform the bending process on the sheet bundle 5. Thus, the sheet bundle 5 can be displaced at the edge 5*a*.

Since the first driving roller 41 that conveys the sheet bundle 5 is used for the process of bending the sheet bundle 5, the process of causing the sheet bundle 5 to be displaced at the edge 5*a* and the conveyance of the sheet bundle 5 can be realized by a smaller number of driving sources and a simple mechanism. Therefore, it is possible to reduce a size of the device. Further, since the number of the driving sources is small, it is possible to suppress power consumption and reduce a cost.

Further, since the pressing roller 42 can be switched between the non-pressing position P3 and the pressing position P4 according to a pivoting position of the sheet bending arm 52, it is not necessary to provide a driving source for moving the pressing roller 42 between the pressing position P4 and the non-pressing position P3. Therefore, it is possible to perform the process of bending the sheet bundle 5 with a simple mechanism without increasing the number of driving sources. Therefore, it is possible to reduce the size of the device. Further, it is possible to suppress the power consumption and reduce a cost.

Since the sheet separator 23 can cause the sheet bundle 5 to be displaced at the edge 5*a* through the process of bending the sheet bundle 5, it is possible to obtain an amount of displacement of the sheets S necessary to ensure an adhesion force of the tape T. Further, when the sheets S constituting the sheet bundle 5 are thin, it is possible to ensure a necessary amount of displacement of the sheets S, for example, in a case in which the number of sheets S is small.

In the sheet separator 23, although the first contact member 55 can come into contact with the trigger 54 and the second contact member 56 can come into contact with the lock projection 73, a configuration in which the first contact member comes into contact with the lock portion to move the pressing body and the second contact member comes into contact with the trigger to move the lock portion to the first lock receiver may be instead adopted.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet separator, comprising:

a first driving roller that rotates about a first rotation shaft and conveys a sheet bundle comprising a plurality of sheets;

a pressing body that is capable of approaching the first driving roller;

a sheet bending arm that is pivotable about the first rotation shaft located on a base end of the sheet bending arm; and a pressing arm that has a lock portion and is pivotable about a second rotation shaft located on a distal end of the sheet bending arm, wherein the first driving roller is rotatable in a first direction with the sheet bundle sandwiched between the first driving roller and the pressing body, and the pressing body pivots in the first direction about the first rotation shaft with the sheet bundle sandwiched between the first driving roller and the pressing body to cause the plurality of sheets to deviate from one another at edges.

2. The sheet separator according to claim 1, further comprising:

a trigger that has a first lock receiver and a second lock receiver that are engageable with the lock portion and is pivotably attached to the sheet bending arm, wherein the pressing body is attached to the pressing arm, and is at a non-pressing position at which the sheet bundle is not pressed when the lock portion is engaged with the first lock receiver, and at a pressing position at which the sheet bundle is pressed when the lock portion is engaged with the second lock receiver, and the trigger is switchable between a first posture in which the lock portion is engaged with the first lock receiver and a second posture in which the lock portion is engaged with the second lock receiver according to a pivotal position of the sheet bending arm.

3. The sheet separator according to claim 2, further comprising:

a first contact member that contacts the lock portion or the trigger when the sheet bending arm is at a first position; and a second contact member that contacts the lock portion or the trigger when the sheet bending arm is at a second position, the sheet bending arm being movable between the first position and the second position in the first direction, wherein the first contact member comes into contact with the lock portion or the trigger to move the pressing body to the pressing position when the sheet bending arm pivots in a second direction opposite to the first direction and reaches the first position, and the second contact member comes into contact with the lock portion or the trigger to move the lock portion to the first lock receiver when the sheet bending arm pivots in the first direction and reaches the second position.

4. The sheet separator according to claim 2, further comprising:

a driving source that drives the first driving roller; and a clutch that switches a connection state between the driving source and the sheet bending arm.

5. The sheet separator according to claim 4, further comprising:

a lock plate that is coupled to the sheet bending arm; and a stopper that is engageable with the lock plate.

6. The sheet separator according to claim 1, further comprising:

a second driving roller that holds the sheet bundle with the sheet bundle sandwiched between the second driving roller and the first driving roller.

7. A sheet post-processing device, comprising:

the sheet separator according to claim 1; and a sheet binding device that attaches a tape to an edge of the sheet bundle that has passed through the sheet separator.

8. An image forming apparatus, comprising:

an image former that forms an image on a sheet; and the sheet post-processing device according to claim 7.

9. An image forming apparatus, comprising:

a sheet feeder that supplies a sheet; and an image former that forms an image on the sheet, wherein the image forming apparatus comprises the sheet separator according to claim 1.

* * * * *